United States Patent [19]

Feurstein et al.

[11] 4,011,155

[45] Mar. 8, 1977

[54] WRAPPED PACKAGE INSPECTION AND REJECTION APPARATUS

[75] Inventors: Ludwig J. Feurstein, Sheboygan; Otis E. Meives, Cleveland; Roger E. Schelk; Larry L. Verhyen, both of Sheboygan, all of Wis.

[73] Assignee: Pemco, Inc., Sheboygan, Wis.

[22] Filed: Mar. 31, 1975

[21] Appl. No.: 563,430

[52] U.S. Cl. ..... 209/74 R; 209/111.7 T; 250/223 R; 53/53; 156/363; 156/378; 156/351

[51] Int. Cl.[2] ..... B07C 5/342

[58] Field of Search ..... 209/111.7, 73, 74 R, 209/74 M, 75; 53/78, 53; 250/223 R; 156/363, 378, 350, 351

[56] References Cited

UNITED STATES PATENTS

| | | | |
|---|---|---|---|
| 2,991,879 | 7/1961 | Innocenti | 53/53 X |
| 3,289,832 | 12/1966 | Ramsay | 209/111.7 X |
| 3,553,041 | 1/1971 | Von Hofe | 156/378 |
| 3,643,552 | 2/1972 | Stork | 53/53 X |

*Primary Examiner*—Allen N. Knowles
*Attorney, Agent, or Firm*—Pollock, Vande Sande & Priddy

[57] ABSTRACT

A package labeling and inspecting apparatus is disclosed which includes a first conveyor table having an apparatus mounted adjacent to the conveyor for applying labels to wrapped packages as they move along the first conveyor table. Provision is made for generating a control signal when a label fails to be applied to a package or is improperly applied. In response to the control signal, a reject conveyor is actuated to remove the defectively labeled package from the conveyor apparatus. Apparatus is also provided for inspecting the condition of the wrapping on the package to determine whether the package has been properly wrapped and, if necessary, to reject any defective packages from the conveying apparatus. The device according to the invention operates automatically to convey, label, inspect and assort wrapped packages.

34 Claims, 22 Drawing Figures

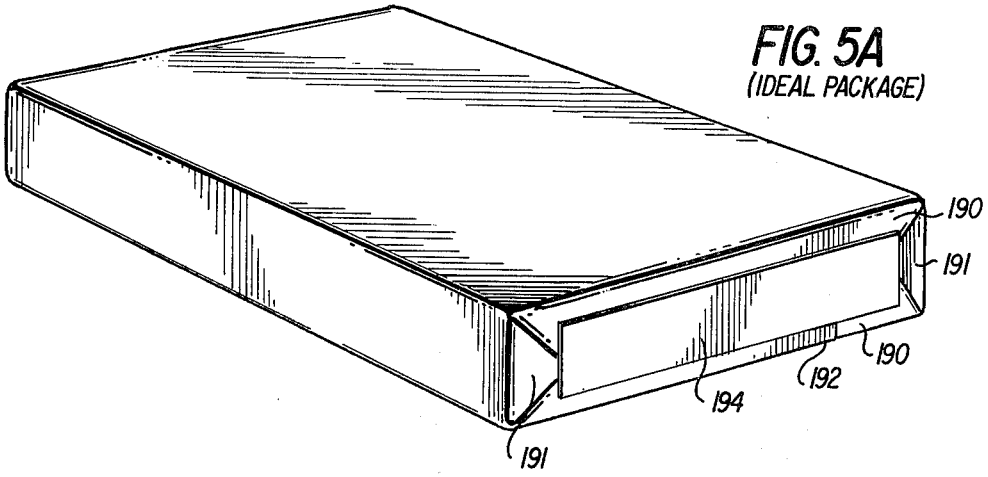
FIG. 5A
(IDEAL PACKAGE)
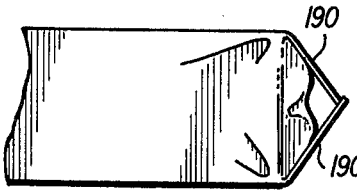
FIG. 5B
(LOOSE END FLAP)
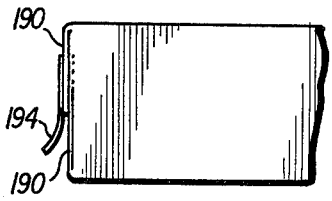
FIG. 5C
(LOOSE LABEL)
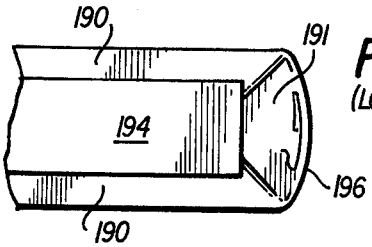
FIG. 5D
(LOOSE GIRTH WRAP)
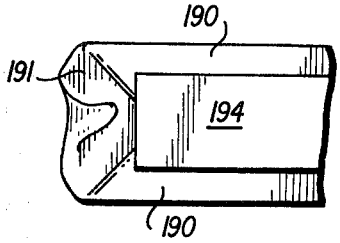
FIG. 5E
(PULLED OUT TUCK)
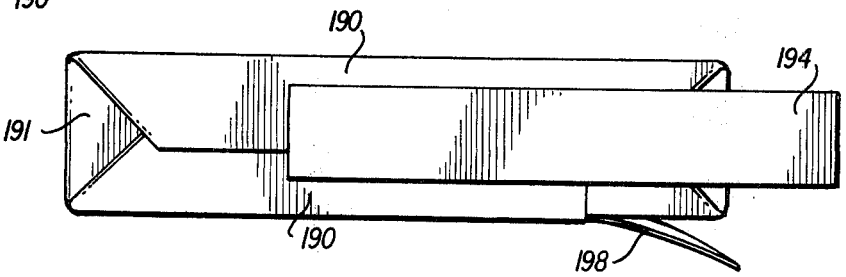
FIG. 5F
(MISAPPLIED LABEL; EXTENDING BOTTOM SHEET)
FIG. 5G
(LOOSE GIRTH SEAM)
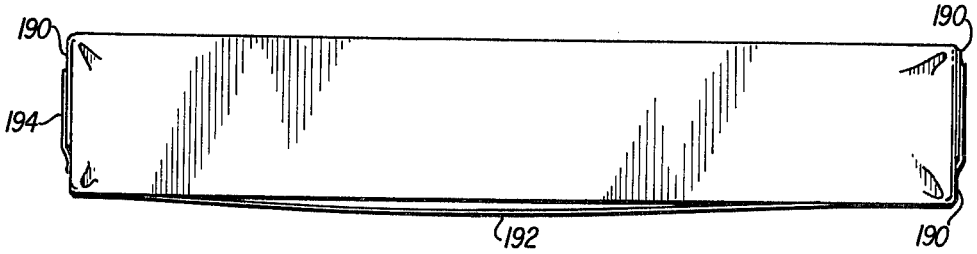

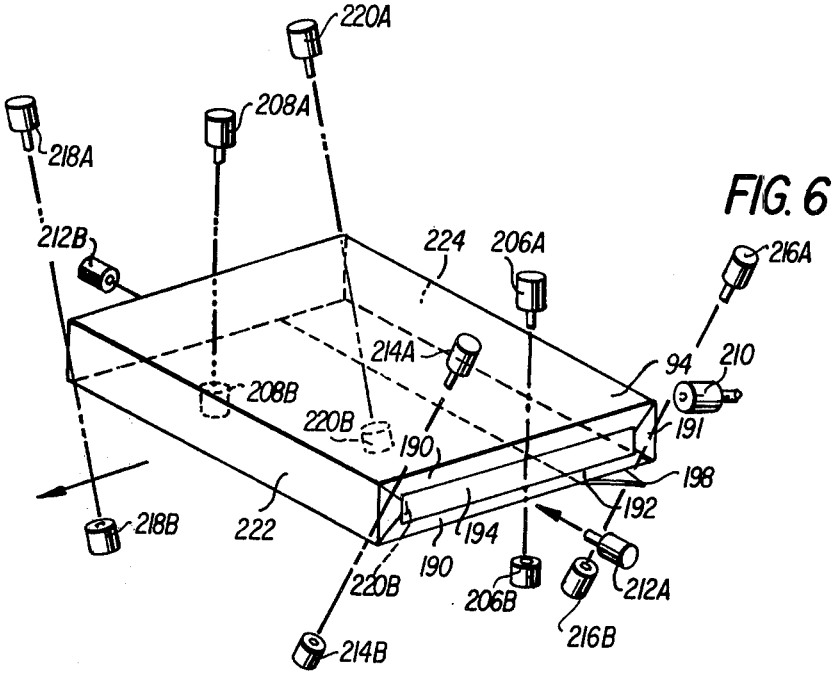
FIG. 6
FIG. 7
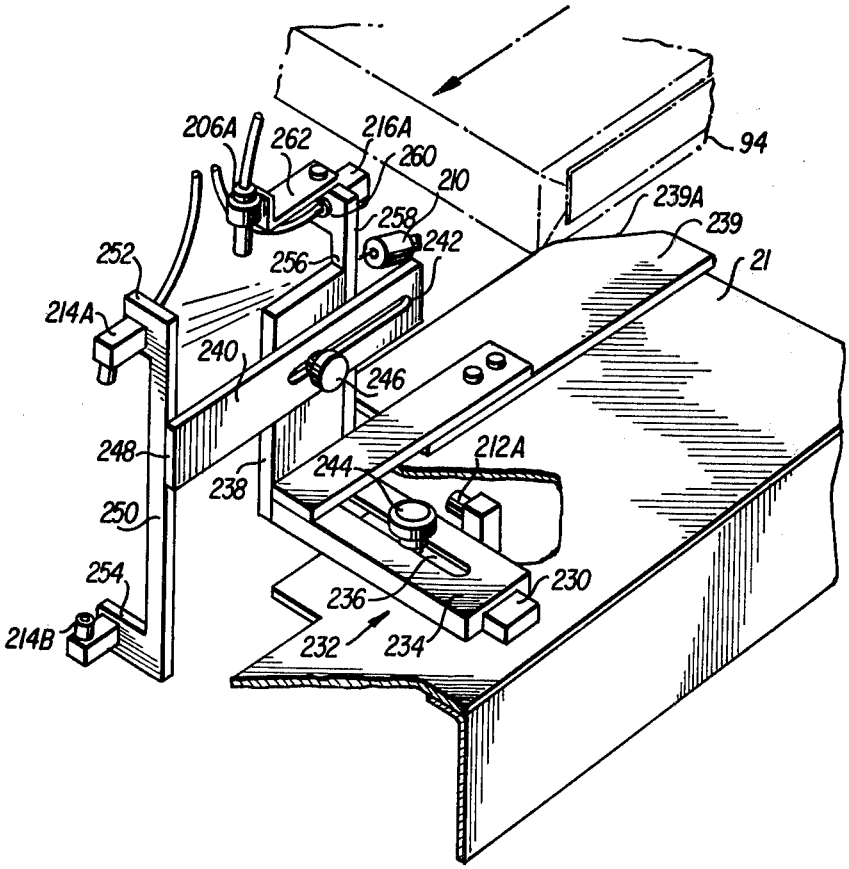

FIG. 13
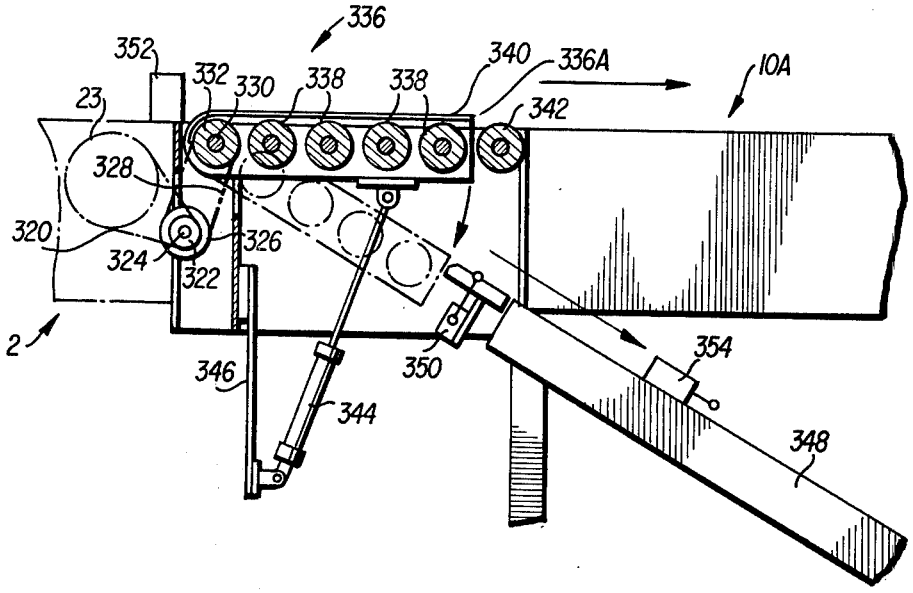
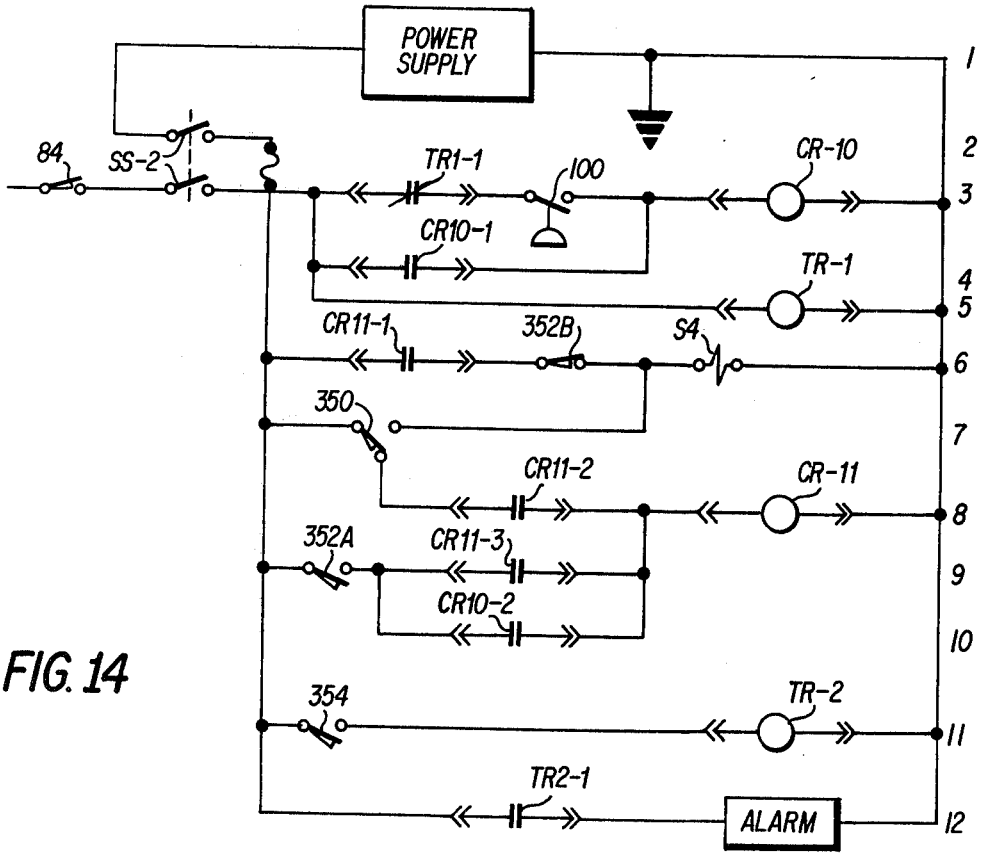
FIG. 14

WRAPPED PACKAGE INSPECTION AND REJECTION APPARATUS

BACKGROUND OF THE INVENTION

The prior art discloses a wide variety of machines adapted for packaging, wrapping and labeling various types of products. For example, U.S. Pat. Nos. 3,213,591 and 3,497,412, assigned to the assignee of the present application, disclose packaging, wrapping and labeling devices peculiarly adapted to the packing, wrapping and labeling of paper products, such as reams of bond paper. To facilitate the shipping and storage of products wrapped and labeled by devices such as those disclosed in the foregoing patents, considerable attention has been directed over the years to ensuring that the wrapping material for the individual products, usually heavy paper, is uniformly applied to the products to produce a wrapped product which is attractive in exterior appearance and uniform in exterior dimensions. Similarly, the label applying devices known in the prior art have been designed to ensure that labels are consistently applied to all packages passing through the labeling apparatus and also consistently applied to a preselected location on the package.

While prior art devices have achieved a great measure of success, instances have been noted where packages leaving known types of wrapping machines are defective due to the presence of loose end flaps on the wrapping paper, loose girth wraps or loose girth seams, pulled out end tucks, sheets of the ream of paper extending through the girth seam of the package, and related problems. Similarly, the label applying apparatus known in the prior art has shown a tendency on occasion to apply labels in an improper location on the package or, in some instances, to fail to apply any label at all. The above mentioned defects in the package wrap and in the placement or non-placement of the package label can lead to later difficulties in handling, packing and storing the wrapped products and in identifying their contents.

Thus, it is apparent that a need exists for an apparatus which will inspect a previously wrapped package to determine whether the package is defective for any of the above or additional reasons and to reject any defective packages from the conveying apparatus on which they are moving. Likewise, a need is evident for means which will detect the misplacement or non-placement of a package label and reject a defective package accordingly.

OBJECTS OF THE INVENTION

An object of this invention is to provide means for detecting the misplacement or non-placement of a label on a wrapped package, generating a signal in response to this detection and rejecting the defective package in response to the generated signal.

A further object of this invention is to provide means for inspecting a wrapped package to determine the existence of defects such as loose end flaps, pulled out tucks, loose girth seams, loose girth wraps, bottom sheet extending through girth seam, label extending past an end of the package and related defects, generating a control signal in response to the detection of such defects and rejecting defective packages in response to the generated control signal.

Yet another object of this invention is to provide a package conveying, labeling and inspecting apparatus in which the placement or non-placement of the package label or a defective package wrap will each cause the generation of a control signal which will operate a single reject mechanism for removing defective packages from the conveying apparatus.

Another object of the invention is to provide an auxiliary conveyor for receiving rejected packages, the conveyor including means for generating a control signal when the reject conveyor is full.

Still another object of the invention is to provide a package wrap inspecting apparatus which may be readily adjusted for inspecting packages of varying sizes.

The above objects of the invention are intended to be merely exemplary; thus, other advantages and improvements inherently achieved by the disclosed invention may be apparent to those skilled in the art. However, the scope of the invention is to be limited only by the appended claims.

SUMMARY OF THE INVENTION

The above objects and other advantages are achieved by the invention which comprises, in one of its embodiments, means for conveying wrapped packages along a predetermined path and means situated adjacent the path for monitoring a plurality of package wrap parameters to determine whether predetermined standards for the package wrap have been exceeded. If these standards have been exceeded, a control signal is produced and means responsive to the control signal reject defectively wrapped packages from the conveying means. Various electronic eye or photo switch devices are disclosed for detecting the defective package wrap parameters.

In another embodiment, the invention comprises a package labeling machine of the type including a conveyor for packages to be labeled, a label magazine and a label applying head for removing labels from the magazine and applying them to the conveying packages. Means are provided for detecting the failure to remove a label from the magazine or the loss of a removed label between the magazine and the point of application of the label to the packages. Upon failure to remove a label or loss of a label, a control signal is produced wich actuates means for rejecting defectively labeled packages from the conveyor. A label applying head is disclosed which is monitored by a vacuum sensitive switch to detect loss of a label between the label magazine and the point of application.

In another embodiment, the invention comprises a package labeling machine of the type previously discussed in combination with means for monitoring a plurality of package wrap parameters to determine whether predetermined standards for the package wrap have been exceeded and means responsive either to a defectively labeled package or a defectively wrapped package for rejecting defective packages from the device. In instances where the package labeling component is separated from the package wrap inspecting component, memory means are provided for synchronizing the operation of the rejecting means to account for this separation.

BRIEF DESCRIPTION OF THE INVENTION

FIGS. 5A through 5G show views of wrapped packages having various types of defects which are detected by the conveying, labeling and inspecting system according to the invention.

FIG. 6 shows a perspective view of a wrapped package and indicates schematically the orientation of electronic photo switch pairs relative to the package as it moves through the inspection apparatus.

FIG. 7 shows a perspective view of a portion of the optical inspection station according to the invention indicating the manner in which the photo switch pairs are mounted relative to the wrapped package as it moves through the apparatus.

FIG. 13 shows another type of reject conveyor adapted for use with the labeling apparatus according to the invention.

FIG. 14 shows the control circuit for use with the reject conveyor and labeler shown in FIG. 13.

DETAILED DESCRIPTION OF THE PREFERRED EMBODIMENTS

Figure 1:
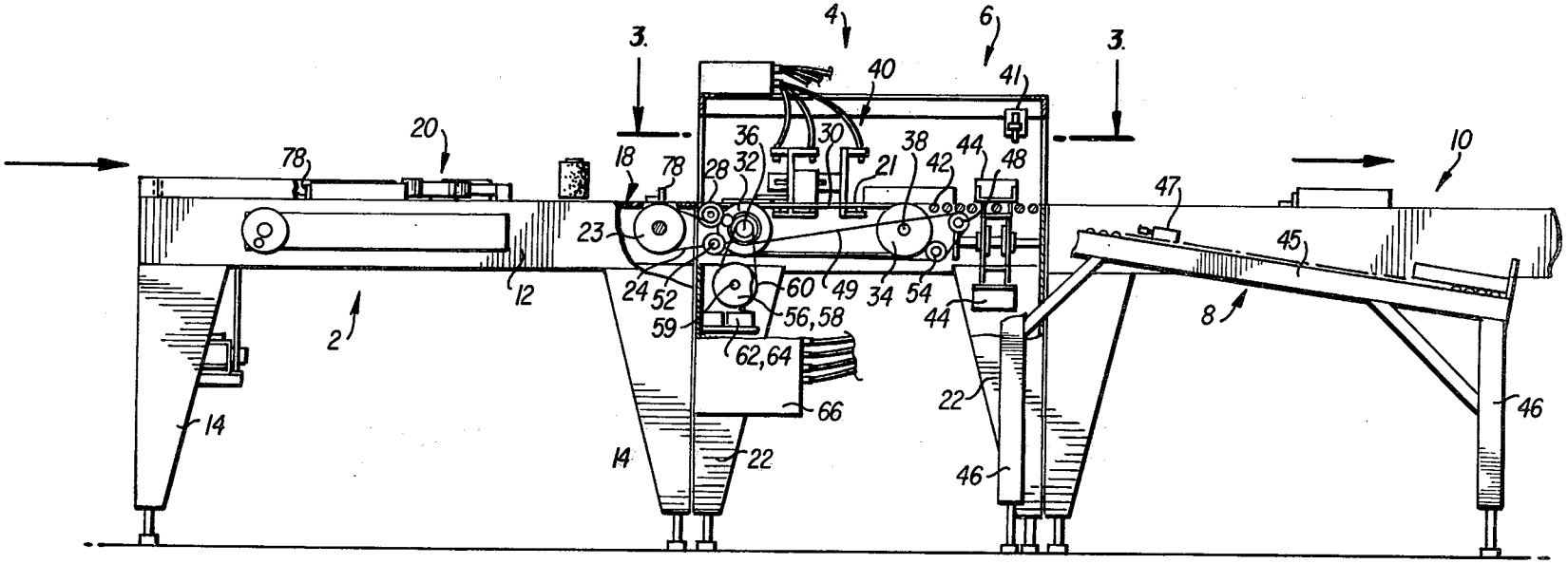
FIG. 1 shows a side elevation view of a package conveying, labeling and inspecting system according to the present invention.

There follows a detailed description of the preferred embodiments of the invention, reference being had to the drawings in which like reference numerals identify like elements of structure in each of the several Figures.

FIG. 1 shows a side elevation view, partially, in section and partially broken away, of one embodiment of the invention. This embodiment comprises several interdependent major components. The first component is a package labeling and conveying machine 2 of the general type disclosed in U.S. Pat. No. 3,497,412, assigned to the same assignee as the present application, the disclosure of which is hereby incorporated by reference in this application. The package labeling and conveying machine 2 is drivingly connected to a package wrap inspecting machine 4 and a defective package rejecting conveyor 6. Rejected packages are discharged from conveyor 6 onto a rejected package storage conveyor 8; whereas, acceptable packages are permitted to pass through machines 4 and 6 onto a conventional out feed conveyor 10.

The package labeling and conveying machine 2 comprises a support table 12 which rests upon a plurality of adjustable support legs 14. Previously wrapped packages move from left to right in FIG. 1 on a conveyor 18 which runs across the upper surface of support table 12, as shown more clearly in FIG. 2. As the wrapped packages proceed across the upper surface of support table 12, they pass a label applying mechanism 20 and after label application are conveyed into the package wrap inspecting machine 4.

Figure 3:
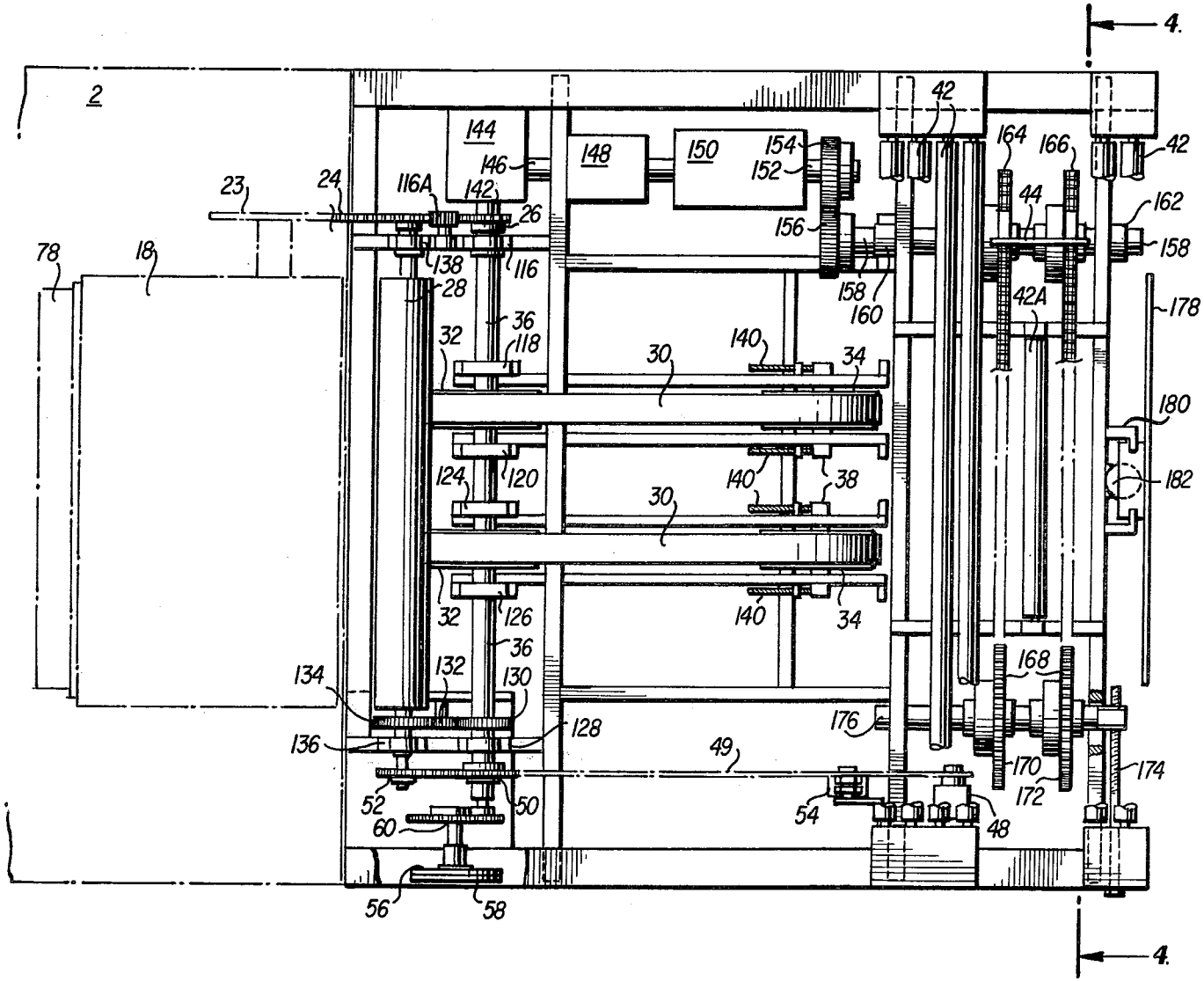
FIG. 3 shows a view taken along line 3—3 of FIG. 1, in which the top plate of the package inspection station has been removed.

Package wrap inspecting machine 4 comprises a top frame 21 mounted on a plurality of adjustable legs 22. A sprocket 23 located at the out-feed end of the package labeling and conveying machine 2 is driven by the out-feed of conveyor 18 and meshes with a chain 24 which is drivingly connected to the drive sprocket 26 of package wrap inspecting machine 24, as seen in FIG. 3. As will be discussed in further detail with respect to FIG. 3, a rubber covered in-feed roller 28 is driven at a higher rate of speed than the out-feed end of conveyor 18 to accelerate the packages into the package wrap inspection area 4 where they are conveyed by parallel Neoprene belt conveyors 30. Belts 30 are also driven by an input received by drive sprocket 26 and from sprocket 23 via chain 24 and are mounted for movement about pairs of pulleys 32 and 34 mounted on drive shaft 36 and adjustable take up shafts 38 respectively. See also FIG. 3.

While a package is moving on conveyor belts 30, it passes through optical package wrap inspection station 40 where the condition of the package wrap is automatically checked. Belts 30 then move the package across rolls 42 of the defective package reject conveyor 6 where the package will be stopped if it has failed to receive a label; or its label has been misapplied; or certain defects in the package wrap have occurred. A photo switch light source 41 cooperates with a light receptor (not shown) located below rolls 42 to detect the presence of a package at this location. If the package is defective, a reject conveyor flight 44, also driven by an input received from drive sprocket 26, pushes the rejected package off onto rejected package storage conveyor 8. Storage conveyor 8 comprises a slanted roller top 45 supported on a plurality of adjustable legs 46 as indicated. If desired, the initial rollers on reject conveyor 8 may be powered in order to accelerate rejected packages onto the storage conveyor. See FIG. 11. A limit switch 47 closes a control circuit when the storage conveyor is full.

If a package is not defective, it moves directly across rolls 42 onto a conventional out-feed conveyor 10. To facilitate movement of the package onto conveyor 10, some rolls 42 are driven by a rubber covered drive roller 48 having an integral drive sprocket thereon driven by a chain 49. Chain 49 meshes wih a further sprocket 50 mounted on drive shaft 36 at the input end of the machine. Idler sprockets 52 and 54 direct chain 49 under sprocket 50 and back around to the integral sprocket of drive roller 48.

A pair of timing cams 56 and 58, mounted on cam shaft 59, are also driven from drive shaft 36 via chain 60. Limit switches 62 and 64 are positioned to be actuated by timing cams 56 and 58, as will be discussed in greater detail subsequently. The control circuitry for the embodiment may be located in housing 66.

Figure 2:
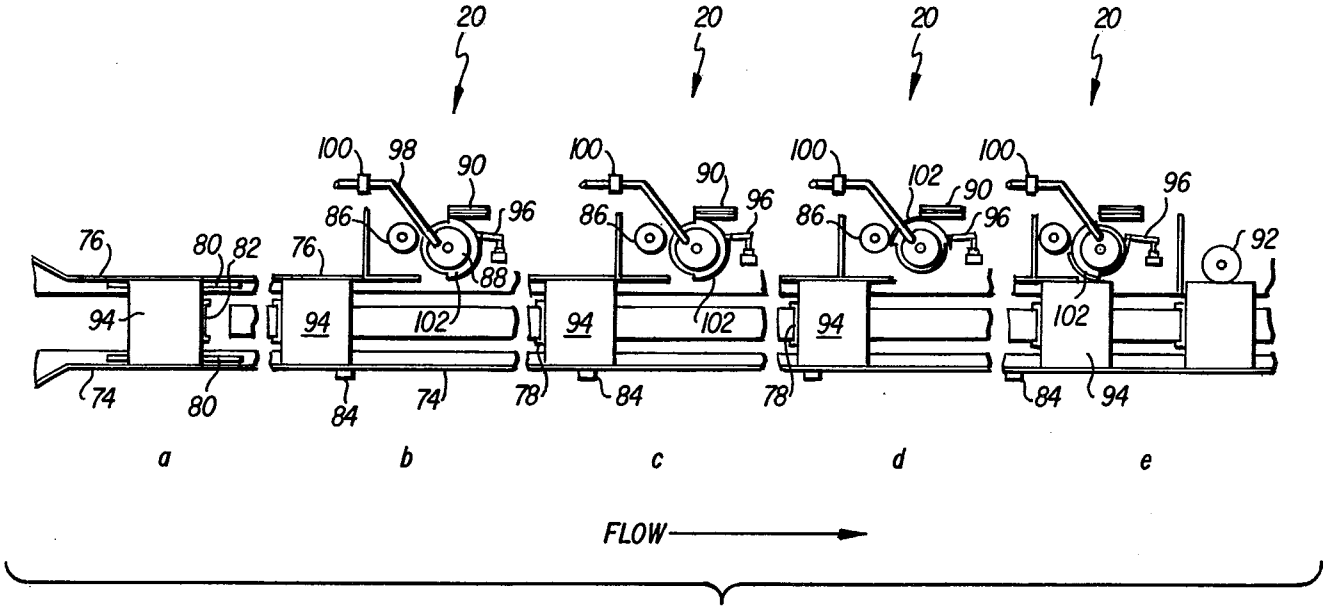
FIG. 2 shows a plan, schematic view of a labeling apparatus embodying certain features of the invention.

FIG. 2 shows a schematic plan view of the upper surface of package labeling and conveying machine 2, indicating in steps (a) through (e) the relative movement of the various elements of the labeling machine as a package passes over its upper surface. Mounted on support table 12 is an upstanding, front guide 74 adapted to act as a front stop for one end of a package. Upstanding rear guide 76 serves as a back stop for the other end of the package. Mounted between guides 74 and 76 is conveyor 18 which is provided with flights 78 for moving packages past label applying mechanism 20.

Mounted adjacent the feed end of conveyor 18 is a pair of transfer belts 80 driven by pulleys mounted on shafts (not shown). Transfer belts 80 are adapted to transfer a package from the next previous operation to the label applying operation, by transmitting the package to conveyor 18. In order to schedule the arrival of packages at the label applying mechanism 20 and to prevent packages from passing through the labeling device before the labeling device is in position to receive a package, a stop bar 82 is provided which protrudes upwardly between transfer belts 80. Stop bar 82, as disclosed more fully in U.S. Pat. No. 3,497,412, prevents the package from passing to conveyor 18 until the labeler is ready to receive the package and thus properly schedules the arrival of the packages irrespective of the rate at which packages are fed to transfer belts 80.

Mounted beside and extending through a slot in front guides 74 is limit switch 84, which is positioned to actuate the label applying mechanism 20 in synchronism with the arrival of each package. Mounted in a cut out section of support table 12, in back of and adjacent to downstream end of rear guide 76 is label applying mechanism 20. Label applying mechanism 20 is adjustable in the vertical and horizontal directions, as shown in U.S. Pat. No. 3,497,412. The label applying mechanism applies labels to a package at varying, predetermined heights along its side and to packages of different lengths. Thus, the package inspecting and rejecting apparatus according to the invention is provided with means for accommodating packages of varying sizes. Mounted on label applying mechanism 20 is gluing mechansim 86. Adjacent gluing mechanism 86 is a label applying vacuum head 88. Vacuum head 88 is supplied with labels by a label magazine 90. Label magazine 90 is adapted to receive a horizontally disposed stack of individual labels and to hold them in a ready position adjacent vacuum head 88. Vacuum head 88 in turn takes one label at a time from the stack, passes it against the gluing mechanism 86 and then applies it to the end of the package as the package moves past vacuum head 88. After the package passes beyond the vacuum head 88, it passes pressure drum 92 mounted on support table 12. Pressure drum 92 applies pressure to the end of the package as the package passes to ensure adherence of the label to the package.

FIG. 2 shows the most basic elements of the type of package labeling and conveying machine used in the present invention and illustrates schematically the sequence of operations in the application of a label to a package. FIG. 2 also shows stop means 96 for vacuum head 88. Label handling mechanism or vacuum head 88 uses a vacuum to pick up labels from magazine 90, via a pneumatic conduit 98. A vacuum switch 100 connected to conduit 98 closes when the vacuum is lost in the label applying head 88.

The operation of the labeler will now be described. The machine may be turned on with a package 94 in place behind stop bar 82 as shown in view (a) of FIG. 2. The trip mechanism of stop bar 82 is operated when vacuum head 88 is in position to receive packages to drop stop bar 82 below the surface of belts 80 momentarily and thereby permit package 94 to advance, as discussed in U.S. Pat. No. 3,497,412. Up until this time, of course, belts 80 have been moving but the package has been held in position by stop bar 82. With the stop bar 82 released, the package 94 then passes to conveyor 18 where one of flights 78 picks it up and begins moving it forward as shown in view (b) of FIG. 2.

At this time, a vacuum is being drawn on vacuum head 88 via conduit 98 to draw the forward end of a label from magazine 90 against the forward end of flange portion 102 of the label applying head 88. Vacuum head 88 is held from rotation by stop means 96, as discussed in U.S. Pat. No. 3,497,412. Moving on to view (c), it is seen that the package 94 is now in a position where it trips limit switch 84. The tripping of limit switch 84 engages the clutch (not shown) of the motor which rotates vacuum head 88 and frees vacuum head 88 to turn one revolution. Closure of limit switch 84 also connects power to line 5 of FIG. 8A; line 4 of FIG. 12; and line 3 of FIG. 14. As vacuum head 88 begins to turn, it sucks a label from magazine 90 forward and removes it from the stack of labels. As flange portion 102 carrying the label comes into contact with gluing means 86, glue is applied to the back of the label. The beginning of this operation is shown in view (d) of FIG. 2.

It is also to be observed that when the labeler reaches the position shown in FIG. 2 (d) a vacuum is still being applied to vacuum head 88 to hold the label against the vacuum head. If vacuum is lost in vacuum head 88 between the point at which a label is removed from magazine 90 and the point at which a label would start to be applied to the passing package 94, then the loss of vacuum in conduit 98 will cause vacuum switch 100 to close. Vacuum loss could be due to no label's being picked up; a label's being misplaced on vacuum head 88 and covering only part of the openings therein; or a label's falling off after being pulled from magazine 90. The closure of switch 100 as the label applying vacuum head 88 moves between these two points indicates that a defective labeling will occur for one of the above reasons or due to other causes. In any of these events, the passing package will be defective due to a missing or misapplied label. As will be subsequently discussed, the closure of vacuum switch 100 between these points actuates the package reject mechanism of the invention.

Figure 8A:
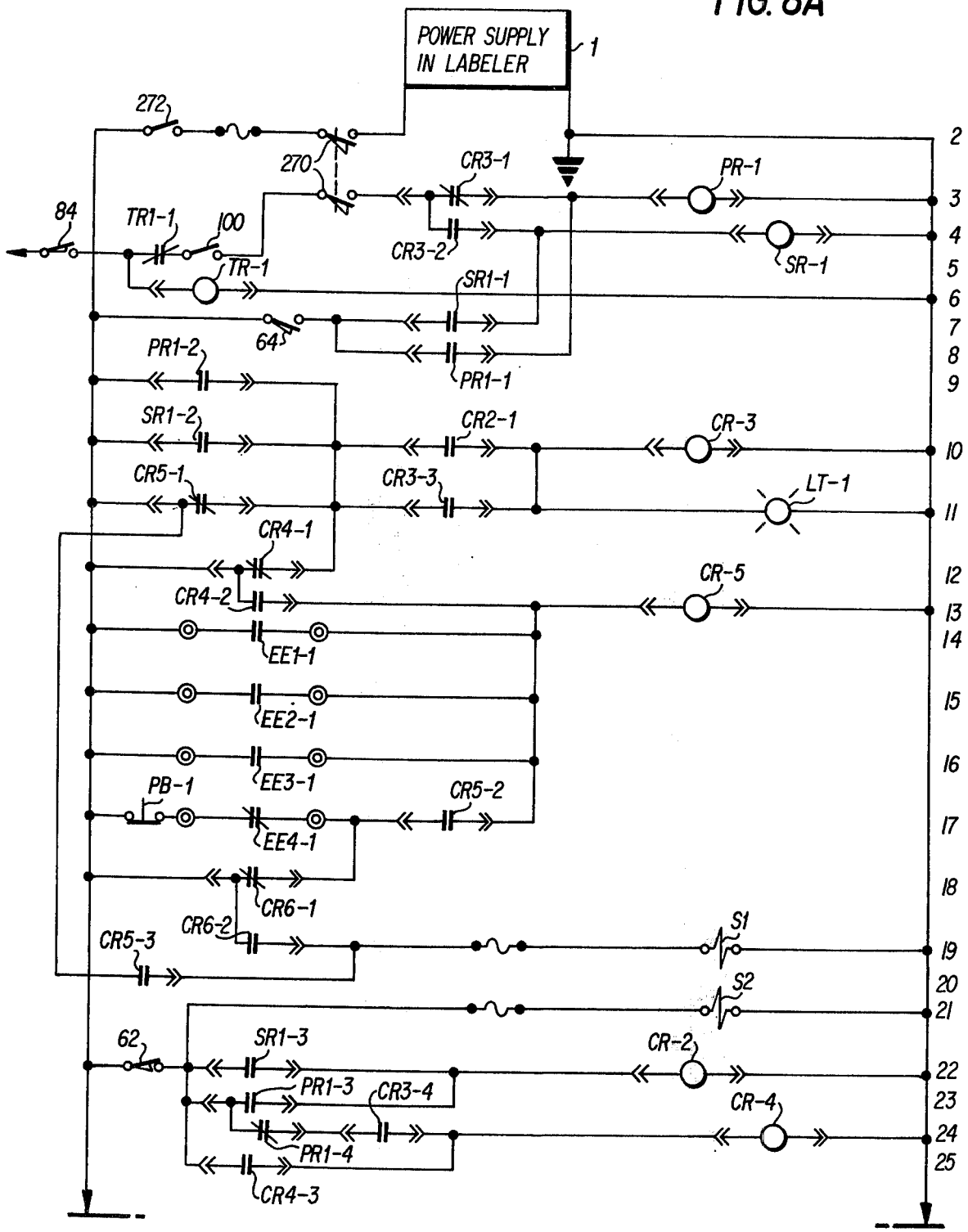
FIGS. 8A and 8B show the control circuitry for use with the embodiment of the invention shown in FIG. 1.
Figure 12:
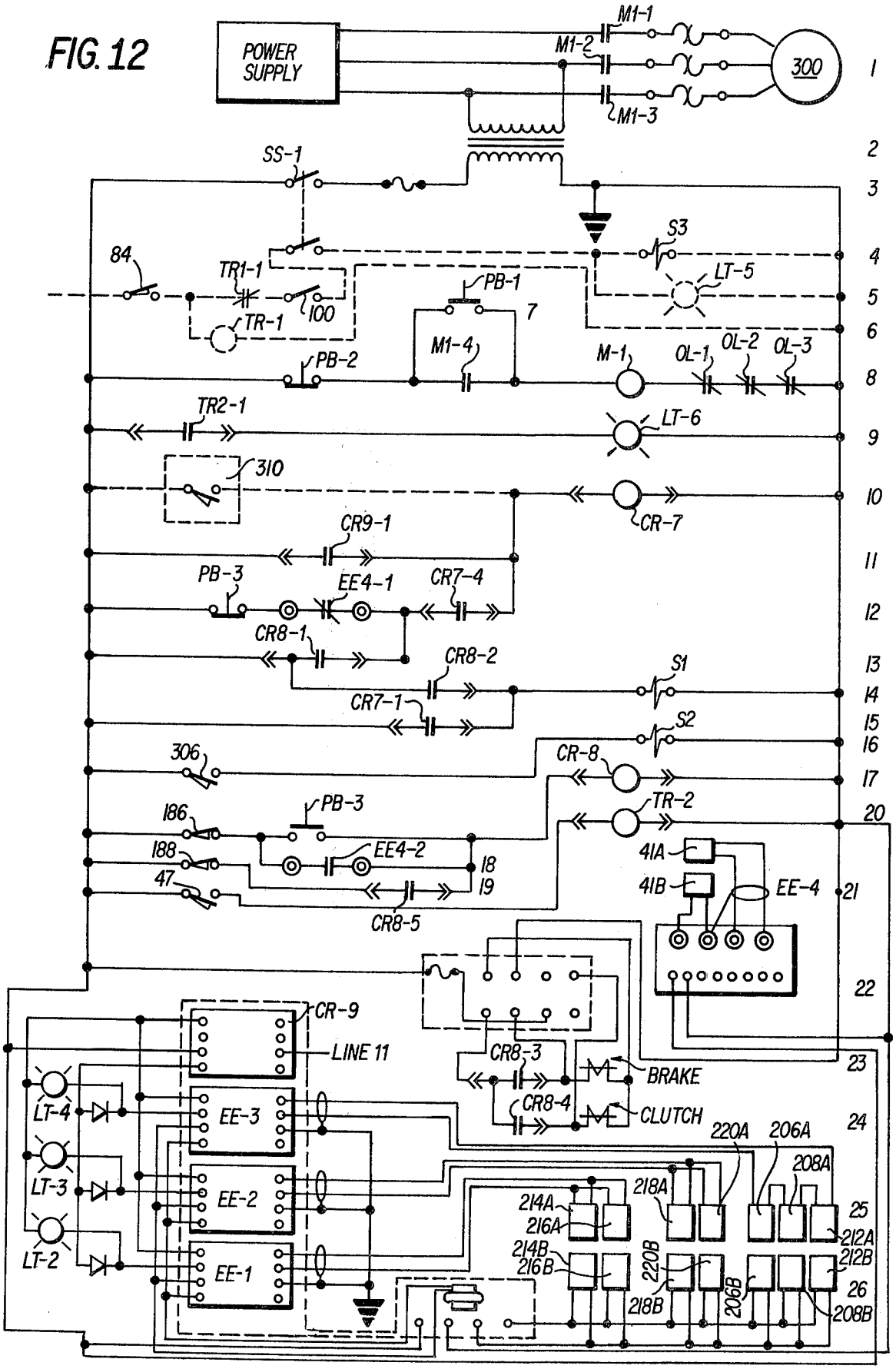
FIG. 12 shows a schematic view of the control circuitry for use with the embodiment of FIG. 11.

As shown in view (e) of FIG. 2, package 94 eventually passes and releases limit switch 84, thus removing power from line 5 of FIG. 8A; line 4 of FIG. 12 and line 3 of FIG. 14. After the label applying head 88 has passed gluing means 86, flange portion 102 of vacuum head 88 is in a position to begin application of a label to package 94. At this instant, the vacuum in vacuum head 88 is released to atmosphere so that the label may be released and pressed against package 94 by flange portion 102 of head 88. Stop means 96 then stops vacuum head 88 when it reaches the position shown in FIG. 2(b) and holds it until switch 84 is actuated by the next package. After package 94 has moved beyond the label applying means 20, it comes into contact with pressure drum 92. Pressure drum 92 is free to rotate and rolls against the label to secure it to the package. If desired, drum 92 could be provided with a heating mechanism to cure or set the glue composition used in the label applying machine.

FIG. 3 shows a view taken along line 3—3 of FIG. 1 in which the top cover plate of the package wrap inspecting station 4 and package rejecting station 6 has been removed to show the interior details of these portions of the invention. Drive chain 24 passes under a take up sprocket 116A to drivingly engage sprocket 26 mounted on the end of drive shaft 36. Drive shaft 36 is mounted for rotation in bearings 116, 118, 120, 124, 126 and 128 at spaced locations across the apparatus, as indicated. Pulleys 32 are mounted between bearings 118 and 120 and 124 and 126. If desired, means such as handwheels and jack screws may be provided to adjust the lateral positions of pulleys 32 and 34 and their adjacent bearings to accommodate different package lengths in the machine. Ideally, belts 30 should be located to support the package near its edges, to facilitate inspection for loose girth seam and extending bottom sheet, as will be further discussed regarding FIG. 7.

Inboard of bearing 128, drive shaft 36 mounts a spur gear 130 which drives a change gear 132 mounted to the machine frame. Change gear 132 in turn drives spur gear 134 which is attached to the shaft of in-feed roller 28. In-feed roller 28 is mounted in bearings 136 and 138, as indicated. The gearing ratios between drive sprocket 23, sprocket 26 and spur gears 130 and 134 are chosen to operate infeed roller 28 at a speed approximately twice as large as that of the out-feed conveyor 18 onto conveyor belts 30 for optical inspection. Pulleys 34 are mounted on adjustable take up shafts 38 which may be adjusted axially via adjustment screws 140 to vary the tension in conveyor belts 30.

The in-feed end of drive shaft 36 is drivingly connected to a right angle gear box 144 having an output shaft 146 connected to a rotary coupler 148. Coupler 148 is connected to a combination electrical clutch and brake unit 150, such as the well known Warner Model no. EP-400. Clutch and brake unit 150 includes an output shaft 152 upon which is mounted a spur gear 154 drivingly connected with spur gear 156 mounted on drive shaft 158 of defective package reject conveyor 6. Drive shaft 158 is mounted for rotation in bearings 160 and 162.

Centrally mounted on drive shaft 158 are spaced drive sprockets 164 and 166 which drive reject conveyor chains 168. A pair of reject conveyor flights 44 are attached to conveyor chains 168. At the opposite side of the machine, a pair of adjustable take up sprockets 170 and 172 mesh with conveyor chains 168. Sprockets 170 and 172 are mounted on take up shaft 176 which is movable via adjustment screws 174 (only one shown) which may be adjusted as necessary to control the slack in conveyor chains 168. Mounted above and between chains 168 is inter-roller 42A which is shortened as indicated to provide sufficient space outboard of sprockets 164, 166, 170 and 172 to permit conveyor flights 44 to rotate about the sprockets on chains 168.

Mounted at the out-feed end of the package inspection and reject apparatus is reject package stop gate 178 slidably mounted to stop gate slide 180 attached to the frame of the apparatus. Stop gate 178 is actuated by reject stop gate cylinder 182, as more clearly seen in FIG. 4.

Figure 4:
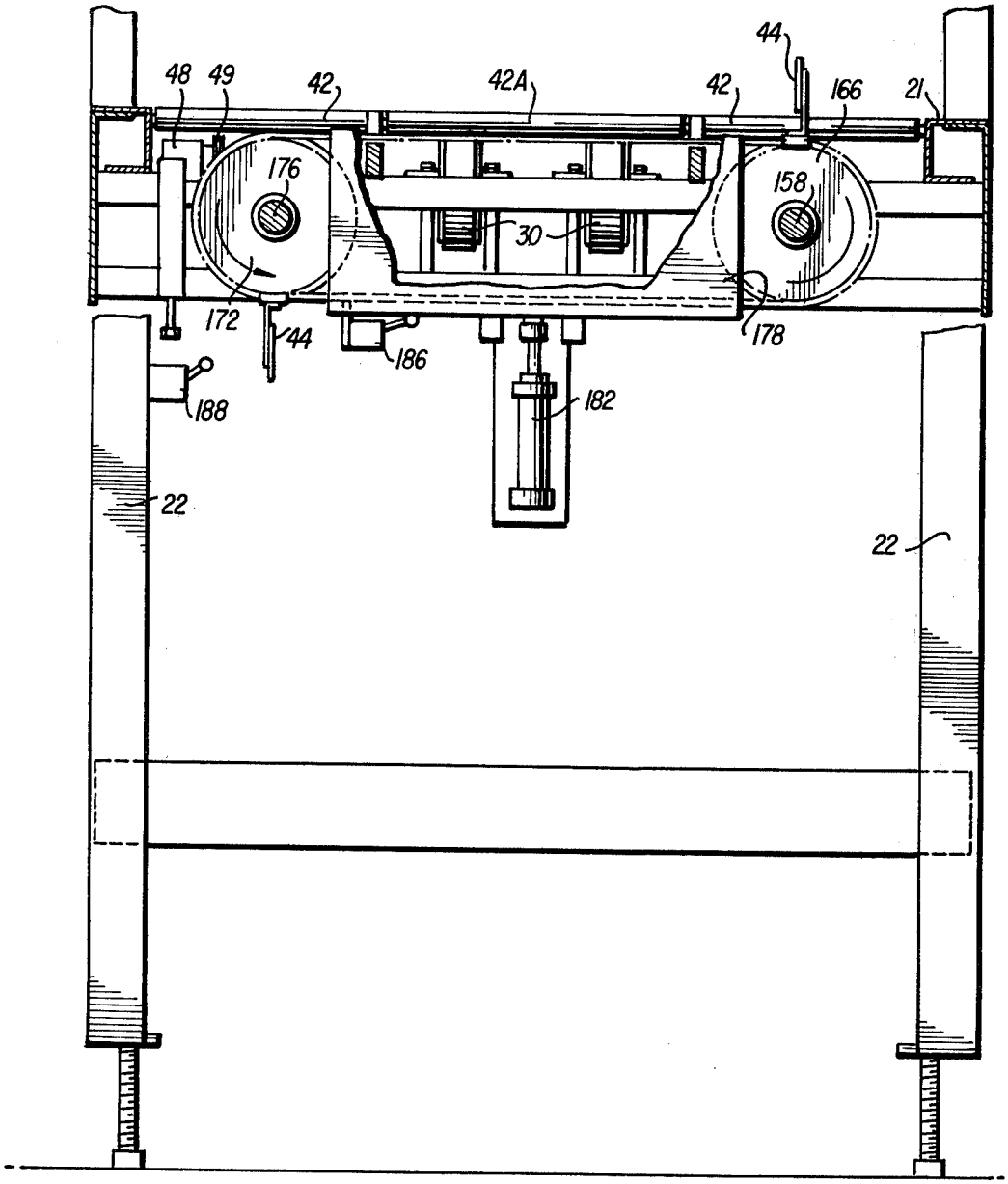
FIG. 4 shows a view taken along line 4—4 of FIG. 3, indicating the details of the reject conveyor system according to the invention.

FIG. 4 shows a view, partially in section, taken along line 4—4 of FIG. 3. When stop gate 178 is in its illustrated, lowered position, a limit switch 186 is contacted by the lower edge of the stop gate. When the stop gate rises to restrain a defective package, limit switch 186 is released, as will be subsequently discussed. Mounted at the side of the machine is a second limit switch 188 which is positioned to be contacted and actuated by flights 44 as they pass switch 188 following reject of a defective package.

FIGS. 5A through 5G illustrate various aspects of a wrapped package of the type labeled and inspected by the apparatus according to the invention. In FIG. 5A, a wrapped package of a product such as sheets of paper is shown which exhibits the features of an ideal wrapping and labeling. The paper wrap is tight all the way around the girth of the package. The end flaps 190 are securely fastened to the end portions of the package and the side tucks 191 are securely in place beneath end flaps 190 to provide a neat, smooth appearance. Girth seam 192 is securely fastened to the top or bottom of the package, thereby preventing a sheet of paper from sticking out through a loose girth seam. Finally, the label 194 has been properly placed in the center of the end of the package over the end flaps 190. Such a package is desirable since it is easily conveyed, stacked and boxed during subsequent handling operations, will not easily break open during handling and is neat and attractive in appearance.

FIG. 5B shows the appearance of the end of the package when end flaps 190 are not properly glued. The flaps extend outside the desired exterior dimensions of the package and may cause jamming or other problems in subsequent processing. FIG. 5C shows the appearance of the end of a package having a loosely applied label thereon. Since the label sticks out beyond the desired dimensions of the package, it may be torn off during subsequent handling, thereby making identification of the package contents difficult. Also, the presence of a loose label may cause undesirable snagging or jamming of the package as it is handled.

FIG. 5D shows the appearance of the side edges of a package when the girth wrap has not been drawn sufficiently tight around the package. In this situation, a bulge 196 occurs on the package edges which increases the overall dimensions of the package and may cause difficulties in subsequent handling. FIG. 5E shows the appearance of a package end in which one of the side tucks 191 has pulled out from beneath end flaps 190. As in the case of the loose girth wrap, this increases the overall dimension of the package and may cause jamming or snagging during subsequent handling operations.

FIG. 5F shows the appearance of the end and bottom of a package which has a misapplied label and an extending bottom sheet. The misapplied label is unattractive in appearance and may be pulled off during subsequent handling. The extending bottom sheet indicates that the product has not been properly wrapped and may also result in subsequent jamming of the package. Finally, FIG. 5G shows a side view of a package having a loose girth seam 192. In this situation, the girth seam bulges open on the top or bottom of the package, thus permitting soil and other contaminates to enter the package and providing a means to cause subsequent jamming or tearing of the package wrap.

FIG. 6 shows a schematic, perspective view of a package 94 and a plurality of electronic eye or photo switch pairs which are oriented to detect the presence of any of the conditions shown in FIGS. 5B through 5G. The arrow indicates the direction of movement of the package through the package wrap inspect station 4.

Looking in the direction of movement of the package, photo switch light sources 206A and 208A and light receivers 206B and 208B are oriented in vertical planes adjacent either end of package 94, the planes being spaced a distance approximately equal to the desired length of a particular package. If package 94 includes loose end flaps or loose labels on either or both ends, the light beams between photo switch pairs 206A-206B and 208A-208B will be broken, thereby causing closure of switches on lines 16 and 32 in the control circuitry shown in FIGS. 8A and 8B, to trigger reject of a defective package.

Figure 8B:
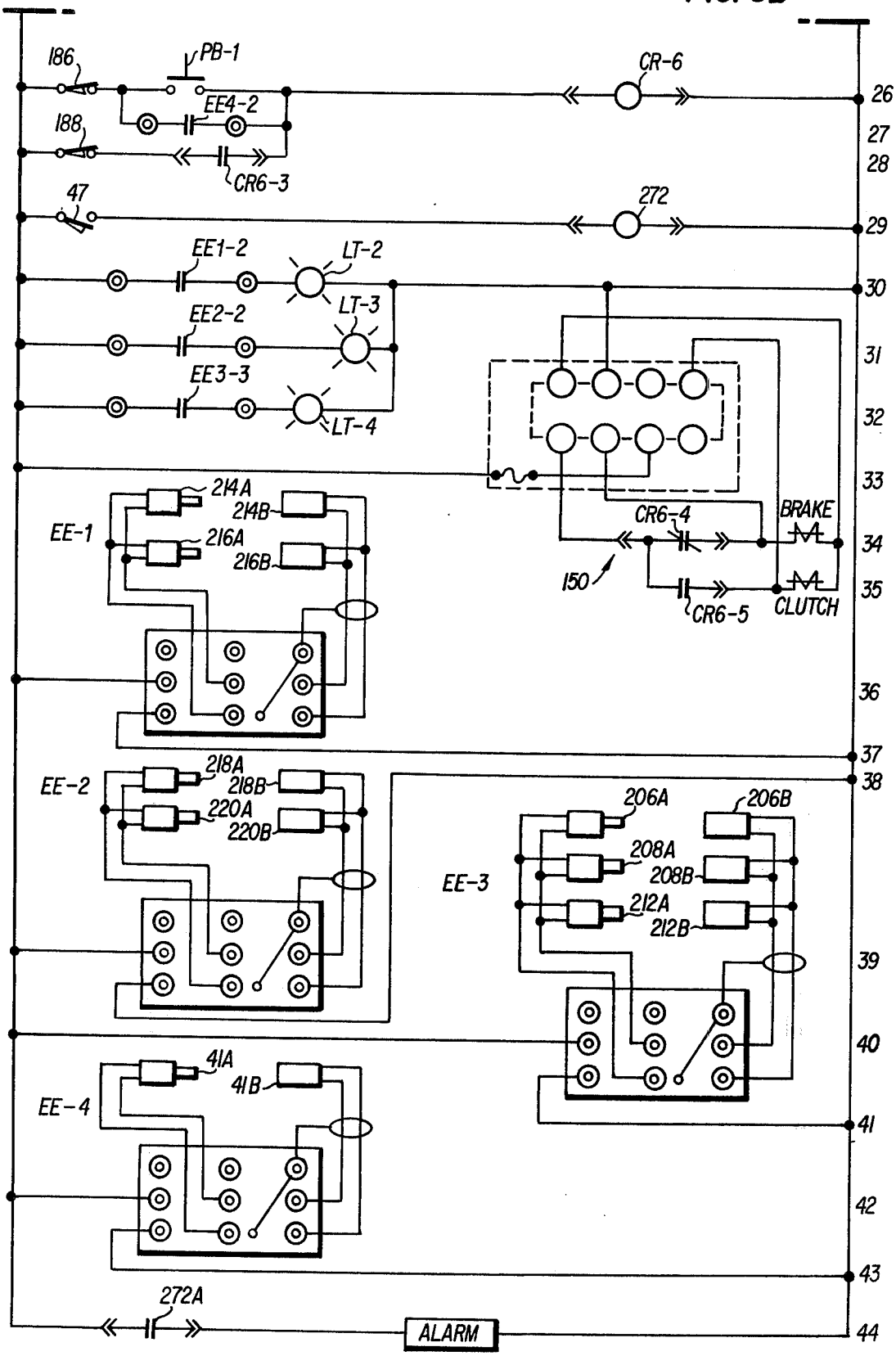

An air jet 210 is actuated by timing cam 58 to direct a blast of air at girth seam 192 to deflect it or an extending bottom sheet into the light beam extending between photo switch pair 212A-212B which is oriented in a horizontal plane containing the bottom of package 94 and is spaced outside the ends of the package. When the beam of elements 212A-212B is broken, a switch in lines 16 and 32 of FIGS. 8A and 8B is closed to trigger the reject of a defective package.

The conditions of loose girth wrap, pulled out tuck and label extending past edge or a bottom sheet extending past the edge of the package are monitored on the left end of the package by photo switch pairs 214A-214B and 216A-216B which are spaced on either side of photo switch pair 206A-206B and separated by a distance approximately equal to the desired width of a wrapped package. Similarly, photo switch pairs 218A-218B and 220A-220B are spaced on either side of photo-switch pair 208A-208B to monitor the presence of loose girth wrap or pulled out tuck or extending sheet on the right side of the package as it moves through the optical inspection station.

Photo-switch pairs 214, 216, 218 and 220 are oriented to project their light beams in planes adjacent the side vertical edges 222 and 224 of the package. The four beams pass approximately over the center of the corner edges of the package 94 as it passes through the inspection station. If the package includes a pulled out tuck, a loose girth wrap an extending sheet or a label extending past the package edge on one or both ends of the package, the beams of photo-switch pairs 214 and 216 on the left end will be broken simultaneously and/or, likewise, the beams of photo-switch pairs 218 and 220 will be broken simultaneously on the right side. When the beams of the photo-switch pairs on either side of the package are broken, switches on lines 14, 15, 31 and 32 of the circuitry shown in FIGS. 8A and 8B are broken, to cause reject of the defective package. Thus, the seven photo-switch pairs shown in FIG. 6 monitor each package as it moves through the apparatus for the presence of one or more of the defects shown in Figures 5B through 5G.

FIG. 7 shows a perspective view of the mounting apparatus for the photo-switch pairs used to inspect the left end of package 94 as it moves through the optical inspection station. A package length adjustment guide key 230 is attached to the upper surface 21 of the package wrap inspection machine and slidably receives an inspection eye support bracket 232. Bracket 232 comprises a first horizontal portion 234 adapted to slide on guide key 230 which includes a longitudinal slot 236 in its upper surface. Integrally attached to horizontal portion 234 is vertical portion 238 to which is attached a package width adjustment guide bar 240 which includes a horizontal slot 242. Guide bar 240 preferably is keyed to vertical portion 238 to guide it in its horizontal movement. Knobs 244 and 246 secure horizontal portion 234 to guide key 230 and adjustment guide bar 240 to vertical portion 238, respectively, to permit easy adjustment of the device for packages of varying width and length. Note that the left and right ends of package 94 should be virtually aligned with the outboard edges of belts 30. This ensures that girth seam 192 will be nearly fully exposed to the air blast from air jet 210. To facilitate alignment of the packages, a guide plate 239 is provided, having a vertical lead-in edge 239A which contacts each package below the label and centers it relative to belts 30.

Attached to the forward end of width adjustment guide bar 240 is forward photo-switch support bar 250 which comprises an upper lateral projection 252 and a lower lateral projection 254. Mounted on upper and lower lateral projections 252 and 254 is photo-switch pair 214A-214B. The lengths of lateral projections 252 and 254 are chosen to angle the beam of photo-switch pair 214A-214B as discussed with respect to FIG. 6 so that the beam passes across the mid-point of the vertical edge of the package in a plane which includes the leading edge 222 of the package as it moves through the apparatus. Attached to the rearward end 256 of vertical portion 238 is rearward photo-switch support bar 258 which comprises an upper lateral projection 260 for mounting photo-switch element 216A and a lower lateral projection (not shown) for mounting photo-switch element 216B. An angle mount 262 is attached to the upper surface of support bar 258 for supporting photo-switch element 206A. Photo-switch element 206B is mounted below surface 21 but is not shown in this view.

Air jet 210 is mounted between conveyor belts 30 in a position to direct its blast at girth seam 192 on the lower side of the package. Photo-switch element 212A is mounted so that its light beam will project just below the level of conveyor belts 30 in a position to be broken by a deflected extending bottom sheet or loose girth seam.

Figure 9:
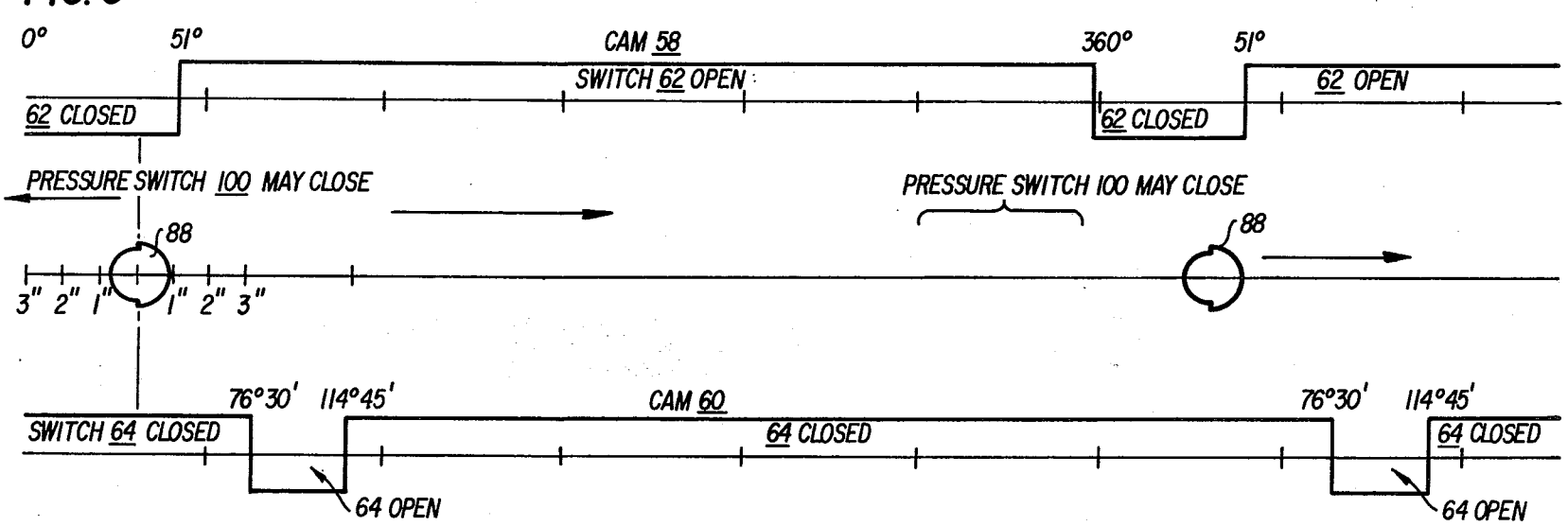
FIG. 9 shows a time graph indicating the positions of a pair of limit switches shown in FIG. 8 in relation to the rotation of a timing cam shaft and to package proximity to the label applying drum.

The cooperative operation of the device shown in FIGS. 1 to 7 may be understood by reference to FIGS. 8A and 8B, showing the control circuitry which coordinates the functions of the various elements of this embodiment; and to FIG. 9, showing the positions of switches 62 and 64 relative to the cam drive shaft 59 and the position of the trailing edge of package 94. To start the device interlock switch 270 is closed and ON-OFF switch 272 is closed connecting electrical power to the control circuit. As package 94 approaches the label applying vacuum wheel 88 on package labeler and conveyor 2, switch 62 (line 22) will be open and switch 64 (line 7) will be closed. When the package closes limit switch 84 (line 3), power is directed to line 5 in FIG. 8A, thereby energizing control relay TR-1 (line 6). Relay TR-1 may be any of a variety of commercially available devices which include a timing portion or circuit which actuates the relay a short period of time after initial energization. Switch TR1-1 (line 5) remains closed until the timing portion actuates the relay portion of TR-1 to open switch TR1-1. When limit switch 84 subsequently opens, TR-1 is deenergized and switch TR1-1 closes. As a first package passes label applying head 88 and receives no label, vacuum switch 100 (line 3) closes due to loss of vacuum caused by a missing label. This energizes the primary reject relay PR-1 (line 3) which in turn causes switch PR1-1 (line 8) to close and hold PR-1 energized via switch 64 (line 7); switch PR1-2 (line 9) to close; switch PR1-3 (line 23) to close; and switch PR1-4 (line 24) to open. When the label applying vacuum head 88 has rotated past the point at which a label should have been applied to the package, the timing portion of TR-1 times out, thereby opening TR1-1 and preventing a fake signal from actuating relay PR-1 when the vacuum is released from label applying vacuum head 88 as it completes its revolution.

With the circuit in this configuration, switch 62 (line 22) is closed by cam 58, as the trailing edge of the package comes within about three inches of the center line of labeler head 88. Switch 62 remains closed for approximately 51° of cam revolution, to permit the following sequence to occur. The closure of switch 62 causes label reject timer relay CR-2 (line 22) to be energized via switch 62 and switch PR1-3. This causes switch CR2-1 (line 10) to close thereby energizing label reject sequence relay CR-3 (line 10) via switch PR1-2. Signal light LT-1 (line 11) is also energized at this time via switches PR1-2 and CR2-1 to indicate defective label application to the operator.

Upon energization of label reject sequence relay CR-3, switch CR3-1 (line 3) opens; however, relay PR-1 remains energized via switch 64 (line 7) and switch PR1-1. Switch CR3-2 (line 4) closes to prepare secondary reject relay SR-1 (line 4) for a label reject signal from the following package, if any. Switch CR3-3 (line 11) closes to hold label reject sequence relay CR-3. Switch CR3-4 (line 24) closes.

Shortly thereafter, switch 62 opens at approximately 51° rotation of cam 58, when missing lable detection, if any, has been completed. It remains open for the remaining 309° of the cam cycle. The opening of switch 62 deenergizes label reject timer relay CR-2 which opens switch CR2-1 (line 10). Label reject sequence relay CR-3 remains energized, however, via switch CR5-1 (line 11) and switch CR3-3. At approximately 76° and 30 minutes rotation of cam 60, switch 64 opens for approximately 38° and 15′, to prepare the control circuit for the next reject signal from the labeler. The opening of switch 64 deenergizes primary reject relay PR-1 which then opens switches PR1-1, PR1-2 and PR1-3; and closes switch PR1-4. Assuming that the second package also will be rejected due to a fualty label application which will be monitored by SR-1, primary reject relay PR-1 is now ready for reception of a label reject signal for the third package in line.

Switch 64 will close at approximately 114° 45′ of revolution of cam 60 and remain closed for the next 321° 45′, during which the second package will pass label applying head 88 and may actuate vacuum switch 100 for a second time. As cam 58 begins its second revolution, switch 62 will again close, thereby energizing label reject relay CR-4 (line 24) via switches PR1-4 and CR3-4. The energization of label reject relay CR-4 causes switch CR4-1 (line 12) to open; switch CR4-2 (line 13) to close. The closure of switch CR4-2 (line 13) causes the reject stop gate relay CR-5 (line 13) to be energized. Thus switch CR5-1 (line 11) opens and deenergizes label reject sequence relay CR-3, provided that the immediately following package has not caused vacuum switch 100 to close again. The sequence of operation when two defectively labeled packages occur in sequence will be discussed subsequently.

The deenergization of label reject sequence relay CR-3 causes the closure of switch CR3-1 (line 3) which prepares PR-1 for reception of a subsequent signal via vacuum switch 100. Switch CR3-2 (line 4) also opens to remove secondary reject relay SR-1 from the circuit leading from vacuum switch 100. Switches CR3-3 (line 11) and CR3-4 (line 24) are opened. The energization of reject stop gate relay CR-5 also causes switch CR5-2 (line 17) to close and to hold relay CR-5 energized. Similarly, switch CR5-3 (line 19) is closed, thereby energizing solenoid S1 (line 19) to raise reject flight stop gate 178 (see FIG. 10), allowing switch 186 (line 26) to close. Finally, the energization of label reject relay CR-4 closes switch CR4-3 (line 25) to hold relay CR-4 energized.

Figure 10:
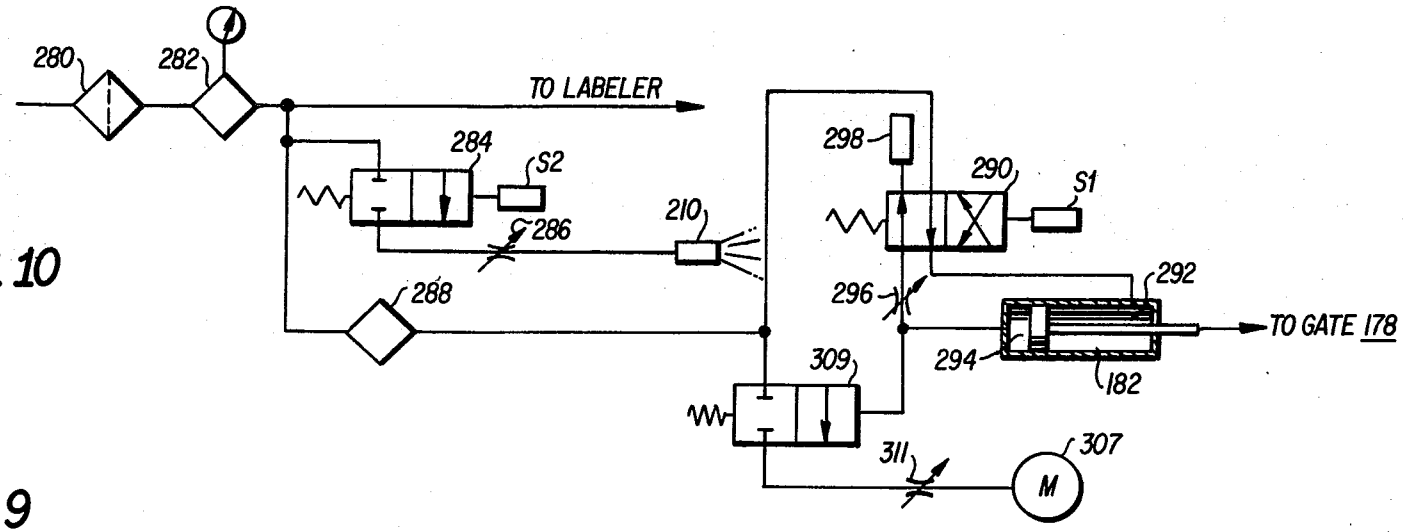
FIG. 10 shows a schematic view of a pneumatic control circuit used in the invention.

The closure of switch 62 also actuates solenoid S2 (line 21) to direct an air blast from air jet 210 at the lower surface of the package, via the pneumatic circuitry shown in FIG. 10. As the package moves through wrap inspection portion 4 of the apparatus, one or more of the individual electronic eye beams or pairs of beams may be broken. If both of the light beams at inspection stations EE-1 (line 37) or EE-2; (line 38) or one or more of the light beams inspection station EE-3 (line 41) are broken, then one or more of switches EE1-1, EE2-1 or EE3-1 (lines 14 to 16) will be closed to energize reject stop gate relay CR-5, provided that relay CR-5 has not been energized by a signal from vacuum switch 100 in the labeler, as previously discussed.

With reject stop gate relay CR-5 energized from either source, switch CR5-2 (line 17) will be closed to hold relay CR-5 energized. Switch CR5-3 (line 20) closes, energizing solenoid S1 (line 19) to raise reject flight stop gate 178. One or more of lights LT-2 (line 30), LT-3 (line 31) and LT-4 (line 32) will also be lighted via switches EE1-2, EE2-2 or EE3-2 to provide a visual indication to the operators of the type of package defect.

Switch 62 subsequently opens at approimately 51° rotation of cam 58 and remains open to the end of the second cam cycle, as previously discussed. The opening of switch 62 deenergizes label reject relay CR-4 and solenoid S2. Switch CR4-1 thus closes and switch CR4-2 opens; however, reject stop gate relay CR-5 will remain energized via switch EE4-1 (line 17) and switch CR5-2 (line 17). After switch 64 has opened at approximately 76° 30′ of cam rotation to remain open until approximately 114° 45′ of cam rotation, the first package continues to move toward reject flight stop gate 178. Switch 64 eventually closes and remains closed until the end of the second cam cycle.

As the first package comes near the reject gate 178 and breaks the light beam of the reject package eye EE-4 (line 43) composed of elements 41A and 41B, switch EE4-2 (line 27) will be closed, thereby energizing reject flight control relay CR-6 (line 26). The closure of relay CR-6 causes switch CR6-3 (line 28) to close and to hold relay CR-6. Simultaneously, switch EE4-1 (line 17) and switch CR6-1 (line 18) open to deenergize reject stop gate relay CR-5. Accordingly, switch CR5-1 closes and switches CR5-2 and CR5-3 open; however, solenoid S1 (line 19) remains energized via switch CR6-2 (line 19). Thus the reject flight stop gate remains up. The energization of reject flight control relay CR-6 also opens switch CR6-4 (line 34) to denergize the brake and closes switch CR6-5 (line 35) to energize the clutch and start the movement of reject flight 44. Thus, the first package is moved from wrap inspector 4 onto rejected package storage conveyor 8 via reject conveyor 6.

As the first package leaves the light beam of reject package eye EE-4, switch EE4-2 (line 27) will open; however, reject flight control relay CR-6 remains energized via limit switch 188 (line 28) and switch CR6-3.

As the package moves onto rejected package storage conveyor 8, switch 188 will be opened momentarily as flight 44 moves past, thereby deenergizing reject flight control relay CR-6. Switch CR6-1 closes, while switches CR6-2 and CR6-3 open, deenergizing solenoid S1 and allowing reject flight stop gat 178 to drop. Switch CR6-4 closes to energize the brake and switch CR6-5 opens to deenergize the clutch, thereby stopping the reject flight conveyor. If the defective package is removed from the machine before it reaches reject conveyor 6, the machine may be cleared by actuating push button PB-1 (lines 17 and 26). After the first package has been rejected and the machine has been cleared, the third cam cycle begins with the closure of switch 62.

Assuming that the second package moving through the apparatus is also defective due to a missing or misapplied label, a signal will be impressed upon line 5 from vacuum switch 100 just before the beginning of the second cam cycle. This causes secondary reject relay SR-1 (line 4) to energize thereby closing switches SR1-1 (line 7), SR1-2 (line 10), and SR1-3 (line 22). When switch 62 closes at the beginning of the second cam cycle, label reject timer relay CR-2 (line 22) will be energized via switch SR1-3. Thus, switch CR2-1 (line 10) closes to maintain label reject sequence relay CR-3 in an energized state via switch SR1-2. Light LT-1 (line 11) also remains lighted. Label reject sequence relay CR-3 will remain energized even if switch CR5-1 has opened during the reject sequence of the immediately preceeding package, as previously discussed. The continued energization of label reject sequence relay CR-3 opens switch CR3-1 and closes switches CR3-2, CR3-3 and CR3-4. The sequence then continues as during the first cycle of cam rotation just discussed, until the second package has been rejected.

When reject storage conveyor is full, limit switch 47 (line 29) is held closed to activate an alarm via timed relay 272 (line 29) and alert the operator to remove rejected packages. When relay 272 times out, switch 272A (line 44) closes to sound an alarm.

FIG. 10 shows a schematic view of the pneumatic control circuit used with the invention. Pressurized air from a source (not shown) is directed through a filter 280 in the pneumatic line leading to the air circuit for the package labeling and conveying machine 2. After passing through filter 280, the air is directed through a pressure regulator 282 and then split into parallel paths. In the first path, the air is directed through a solenoid actuated valve 284 which is controlled by solenoid S2, shown in FIG. 8A and 8B. In one position of the valve 284, air flow through the first path is stopped; however, in the second position of valve 284, air flow is directed through a variable restriction 286 to air jet 210 from which it issues to deflect a loose girth seam or extending bottom sheet.

The second parallel flow path passes through a lubricator 288 and into a valve 290 which is acutated by solenoid S1 shown in FIGS. 8A and 8B. In the first position of valve 290, air flow is directed to the rod end 292 of stop gate cylinder 182 to hold the stop gate 178 in its retracted position. At this time, the piston end 194 of cylinder 182 is connected via variable restrictor 296 to a muffler 298. When solenoid S1 is energized to raise the reject stop gate 178, valve 290 shifts to its second position in which air flow is directed to the piston end 294 of cylinder 182 to raise gate 178. At this time, pressure from piston end 294 is directed to the pilot section of two-way valve 309 which shifts to direct air flow from the second path through a variable restrictor 311 to air motor 307. The purpose of air motor 307 will be explained with regard to FIG. 11. When reject gate 178 drops, air motor 307 stops.

Figure 11:
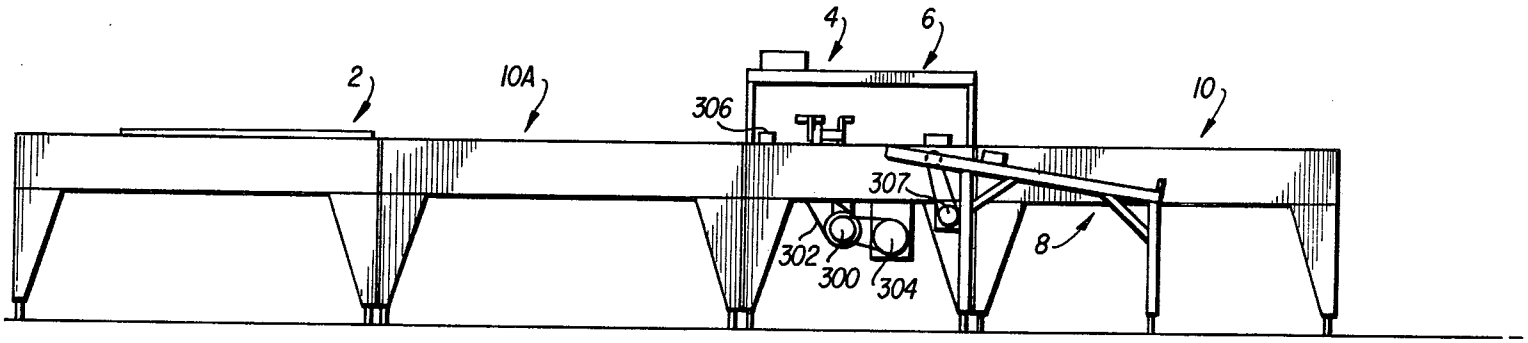
FIG. 11 shows a side elevation view of a further embodiment of the invention.

FIG. 11 shows a further embodiment of the invention in which the package labeling and conveying machine 2 is separated from the package wrap inspecting machine 4 and defective package rejecting conveyor 6 by an intermediate conveyor 10A or other processing apparatus. This separation of the labeling machine from the inspecting and rejecting machine requires that the inspecting and rejecting machine include its own independent drive. Further, some provision must be made for synchronizing the operation of the labeling machine and the inspecting and rejecting machine. Thus, in this embodiment, timing cams 58 and 60 as shown in FIG. 1 are deleted and replaced by an independent drive motor 300 for the package inspecting and rejecting machine which is attached directly to drive shaft 36 (See FIG. 3) via a drive chain 302. Synchronization between the labeling machine and the inspecting machine is achieved through the use of a memory device which accounts for the delay experienced by a defective package as it passes from the labeling machine to the optical inspecting and rejecting machine over the intermediate conveyor 10A. A mechanical ball memory 304 of the type manufactured by the Ebert Engineering Company of Troy, Michigan is preferred in this embodiment; however, those skilled in the art will realize that other types of memory apparatus could be used with equivalent results. When such a ball memory is used, a missing or misapplied label will set the ball memory to actuate the defective package reject conveyor 6 at a later time chosen to account for the distance between the labeling machine 2 and the reject conveyor 6. As the package enters the package wrap inspecting station 4, a limit switch 306 is closed to actuate the package wrap inspection sequence. FIG. 11 also illustrates the optional provision of an air driven motor 307 on rejected package storage conveyor 8, to accelerate rejected packages away from the defective package reject conveyor 6. See FIG. 10. In other respects, the operation of this embodiment of the invention is similar to that of the embodiments shown in FIGS. 1 through 4.

The operation of the embodiment of the invention shown in FIG. 11 may be understood by reference to FIG. 12 which shows the control circuitry for this embodiment. In operation, the apparatus is set in motion by closing switch SS-1 (lines 3 and 4). Push button PB-1 (line 7) is then depressed to start drive motor 300 via relay M-1 (line 8), and switches M1-1, M1-2, M1-3 (line 1) and M1-4 (line 8). Overload switches OL-1, OL-2 and OL-3 (line 8) protect motor 300. Push button PB-2 may be used to stop motor 300. The package inspector is then ready to receive packages, assuming the air supply is properly adjusted.

As label applying vacuum head 88 begins its rotation when limit switch 84 closes as discussed with respect to FIG. 2, power is impressed upon line 4 to actuate timed relay TR-1 (line 6). Switch TR1-1 (line 4) remains closed until relay TR-1 times out, as previously discussed. As a package passes label applying vacuum head 88 and a label is not applied or is misapplied, vacuum switch 100 (line 4) will close in response to the loss of vacuum in label applying vacuum head 88. This energizes solenoid S3 (line 4) which pushes a ball into the memory drum of the ball memory. Obviously, solenoid S3 could be replaced by another suitable actuating mechanism or circuit when a different type of memory is used. Light LT-5 (line 5) is also actuated to indicate the presence of a defectively labeled package.

When the defective package reaches the optical ream inspector, the ball in the memory drum closes ball memory limit switch 310 (line 10) in the usual manner for such memory devices, thereby energizing reject stop gate relay CR-7 (line 10). Switch CR7-1 (line 15) closes to energize solenoid S1 (line 14) and raise reject stop gate 178. As reject stop gate 178 rises, stop gate extended limit switch 186 (line 17) closes.

When the defective package enters defective package reject conveyor 6, the light beam of reject package position eye EE-4 (line 21) is broken. This causes switch EE4-1 (line 12) to open and deenergize reject stop gate relay CR-7 (line 10) for the next defective package. Switch EE4-2 (line 18) also closes to energize reject flight control relay CR-8 (line 17). Switches CR8-1 (line 13) and CR8-2 (line 14) maintain solenoid S1 energized. Switch Cr8-3 (line 23) opens to release the brake and switch CR8-4 (line 24) closes to engage the clutch, thereby starting defective package reject conveyor 6 in motion. As the defective package leaves the apparatus, the beam of reject package position eye EE-4 is reestablished; however, switch CR8-5 (line 19) holds relay CR-8 in its energized position until the reject conveyor has completed its cycle and momentarily opened discharge flight position limit switch 188 (line 19). Opening switch 188 deenergizes relay CR-8, drops reject stop gate 178 and completes the reject cycle for a missing or misapplied label.

The operation of the optical inspection portion of this embodiment is similar to that previously discussed. As the package enters the optical inspection station, air blast timing limit switch 306 (line 16) is closed by the passing package, thereby energizing solenoid S2 (line 16) to direct a blast of air at the girth seam of the package. After the package has passed through the electronic eye inspection area, the contacts of switch 306 open solenoid S2 is de-energized. When the package is in the area of electronic eyes EE-1 (line 26), EE-2 (line 25) and EE-3 (line 24), it is checked for proper girth seam, loose end flap, loose label and pulled out right and left tuck and extending bottom sheet, as previously discussed. If a reject is necessary due to a defective package wrap, pilot lights LT-2 (line 25), LT-3 (line 24), or LT-4 (line 24), will light indicating which aspect of the package wrap is defective. Package rejection is controlled by inspection eye control relay CR-9 (line 23) which is energized when the beam of one or more of the electric eyes at stations EE-1, EE-2 and EE-3 is broken. When relay CR-9 is energized, switch CR9-1 (line 11) is closed to energize reject stop gate relay CR-7 (line 10). Thereafter, the reject sequence proceeds as previously discussed for this embodiment from the point at which relay CR-7 was energized in response to a signal from the missing label detector via switch 310. If a rejected package is removed before it reaches stop gate 178, manual discharge reject push button PB-3 (lines 12 and 17) may be depressed to recycle the reject sequence.

As packages are rejected onto the reject storage conveyor, they actuate the reject detector limit switch 47 (line 20). When the conveyor is full, the last package holds switch 47 in the closed position, thereby energizing the reject alarm control relay TR-2 (line 20). Switch TR2-1 (line 9) is closed to actuate alarm light LT-6 (line 9).

When it is desired to operate the package wrap inspector and reject conveyor without any interconnection to a labeling machine, the circuits shown in dashed lines in FIG. 12 may be omitted, along with ball memory 304 and its associated drive mechanism. The labeler may also be operated independently as will now be discussed.

FIG. 13 shows an alternate type of missing or misapplied label reject system adapted for use with the package labeling and conveying machine 2. The device fits between labeling and conveying machine 2 and a conventional conveyor 10A. The output end of conveyor 2 drives a sprocket 23 which meshes with a chain 320 which in turn, meshes with sprocket 322 mounted on drive shaft 324. A second sprocket 326 mounted on drive shaft 324 meshes with chain 328 which drives a sprocket (not shown) mounted on shaft 330 of infeed roller 332.

Infeed roller 332 receives packages from package labeling and conveying machine 2 and accelerates them onto label reject conveyor 336. Label reject conveyor 336 comprises a plurality of rollers 338 mounted for rotation in a frame 340 which is pivoted at the infeed end of conveyor 336 for movement about shaft 330 to the position shown in phantom. An outfeed roller 342 is mounted to receive unrejected packages moving over rollers 330 and 338 and deliver them to outfeed conveyor 10A.

An air cylinder 344 mounted on frame 346 is atached to frame 340 and supports label reject conveyor in its raised position until a defective package is detected. When a defective package is detected, cylinder 344 is actuated to lower reject conveyor 336 to its phantom position below the level of labeler 2, in which conveyor 336 aligns its outfeed end with rejected package storage conveyor 348 similar in structure to rejected package storage conveyor 8, shown in FIG. 1. A limit switch 350 is mounted near the input end of storage conveyor 348 to monitor the passage of a rejected package. Similarly, a limit switch 352 is mounted at the input end of reject conveyor 336 to monitor the passage of a package onto the reject conveyor. Limit switch 352 is located to ensure that reject conveyor 336 is lowered and raised in synchronization with defective and acceptable packages. Finally, a limit switch 354 is mounted on storage conveyor 348 to provide a signal when conveyor 348 is full of defective packages.

The operation of the automatic labeling machine with its own reject mechanism as shown in FIG. 13 may be understood by reference to FIG. 14 where the control circuitry for this embodiment of the invention is shown. To commence operation, switch SS-2 (lines 2 and 3) is closed. When a package closes limit switch 84 (FIG. 2), power is directed to line 3 in FIG. 14, thereby energizing a timing circuit in label detector timing relay Tr-1 (line 5). Switch TR1-1 remains closed until the timing circuit actuates the relay portion of TR-1. The subsequent actuation of the relay portion of TR-1 will open switch TR1-1 (line 3), as will be described.

Should a package fail to receive a label, vaccum switch 100 (line 3) closes, energizing missing label detector relay CR-10 (line 3). Accordingly, switch CR10-1 (line 4) closes to hold relay CR-10 int eh energized position and switch CR10-2 (line 10) closes to set the apparatus for reject of the defective package. After label applying vacuum head 88 has rotated past the point at which a label should have been applied to the package, the timing portion of TR-1 times out, thereby opening contact TR1-1 and prevent a false signal from actuating relay CR-10 when the vacuum is released from label applying vacuum head 88 as it completes its revolution. CR-10 and TR-1 are both de-energized before the next labeling sequence; thus, contacts TR1-1 close in preparation for the next labeling sequence.

Assuming that a reject signal has been received by detector relay CR-10, the defective package will continue its movement until it strikes package detector limit switch 352 (lines 6 and 9). Switch 352 is positioned upstream of swinging end 336A of conveyor 336 so that it is actuated by a defective package before relay CR-10 has been deenergized by timing relay TR-1 during the cycle for that package, but is released by a defective package only after a previous, acceptable package has passed over roller 342 onto outfeed conveyor 10A. This causes switch 352A line (line 9) to close thereby energizing reject conveyor control relay CR-11 (line 8) via switch CR10-2. Accordingly, switches CR11-1 (line 6), CR11-2 (line 8), and CR11-3 (line 9) to close. The actuation of package detector limit switch 352 also causes switch 352B (line 6) to open. After the package has passed switch 352, switch 352B closes, thereby energizing solenoid S4 (line 6) to lower the reject conveyor 336, via air cylinder 344 and pneunatic circuitry of the general type shown in FIG. 10. Those skilled in the art will realize that to adapt the gate control portion of FIG. 10 for use with the embodiment of FIG. 13, S4 would replace S1 and th porting of cylinder 182 would be reversed. Simultaneously, switch 352A opens; however, reject conveyor control relay CR-11 remains energized via switch CR11-2 (line 8) and limit switch 350.

The rejected package passes down reject conveyor 336 onto rejected package storage conveyor 348 and strikes reject conveyor raising limit switch 350, moving it up to the alternate position indicated. This maintains solenoid S4 in the energized condition and deenergized relay CR-11. Accordingly, contacts CR11-1, CR11-2 and CR11-3 will open. When the package has passed limit switch 350, it returns to its lower position, thereby denergizing solenoid S4 and returning reject conveyor 336 to its elevated position.

As the number of rejected package builds up on reject conveyor 348, rejected package detector limit switch 354 (line 11) eventually is held closed, thereby energizing reject alarm control relay TR-2 (line 11). Energization of relay TR-2 causes switch TR2-1 (line 12) to close and actuate an alarm.

Figure 15:
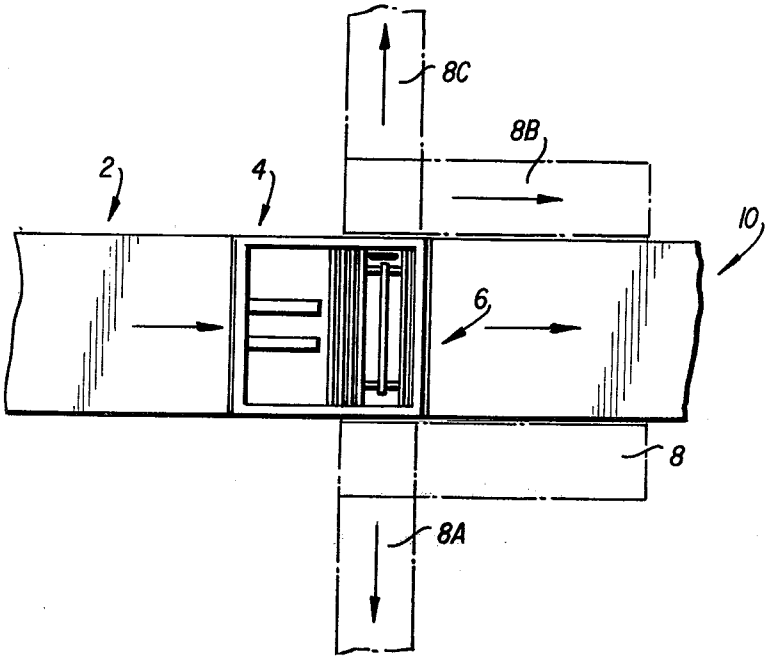
FIG. 15 shows a schematic illustration of alternate orientations of the reject conveyor according to the invention.

FIG. 15 shows a plan view indicating schematically alternate orientations of rejected package storage conveyor 8. In FIGS. 1 and 11, conveyor 8 is shown located on the right side of the machine parallel to the direction of flow of packages. Those skilled in the art will realize, however, that the reject storage conveyor may be alternatively located as indicated at 8A and, by minor rearrangement of the drive train for the defective package reject conveyor, in positions 8B and 8C, without departing from the spirit of the invention. The various alternative locations for the rejected package storage conveyor may be dictated by space limitations in a particular application.

Having described our invention in sufficient detail to enable those skilled in the art to make and use it, we claim:

1. An improved inspecting and sorting apparatus for essentially retangular wrapped packages of the type wherein the wrapping covers all surfaces of the wrapped product, comprising:

means for continuously conveying said packages along a path without reorienting said packages during inspection;

means for monitoring a plurality of different package wrap parameters of a continuously moving package without contacting said package, to determine whether one or more of a plurality of predetermined standards for the package wrap have been exceeded on one or more of said plurality of different, separate surfaces of said packages; and means responsive to said parameter monitoring means for rejecting defectively wrapped packages from said conveying means.

2. The appartus according to claim 1, further comprising means for conveying and storing said rejected packages.

3. The apparatus according to claim 1, wherein said monitoring means includes means for signalling the presence of loose end flap or end labels of said package wraps.

4. The apparatus according to claim 3, wherein said means for signalling the presence of loose end flaps or end labels comprises at least one photo switch pair oriented in a plane adjacent at least one of the ends of said wrapped package, at at least one station along said path.

5. The apparatus according to claim 1, further comprising means for aligning said continuously moving packages on said conveying means as said packages approach said monitoring means.

6. An improved inspecting and sorting apparatus for wrapped packages, comprising:

means for continuously conveying said packages along a path;

means for monitoring a plurality of package wrap parameters of a continuously moving package without contacting said package, to determine whether predetermined standards for the package wrap have been exceeded, said monitoring means including means for signalling the presence of pulled out tucks or loose girth wrap of said package wrap; and means responsive to said parameter monitoring means for rejecting defectively wrapped packages from said conveying means.

7. The apparatus according to claim 6, wherein said means for signalling the presence of pulled out tucks or loose girth wrap comprises at least one photo switch pair oriented in a plane adjacent each side edges of said wrapped package, at at least one station along said path.

8. The apparatus according to claim 7, wherein said photo switch pair is oriented to project its light beam approximately over the center of the corner edges of said wrapped package.

9. An improved inspecting and sorting apparatus for wrapped packages, comprising:

means for continuously conveying said packages along a path, means for monitoring a plurality of package wrap parameters of a continuously moving package without contacting said package, to determine whether predetermined standards for the package wrap have been exceeded, and said monitoring means including means for signalling the presence of loose girth seam of said package wrap; and means responsive to said parameter monitoring means for rejecting defectively wrapped packages from said conveying means.

10. An improved inspecting and sorting apparatus for wrapped packages, comprising:

means for continuously conveying said packages along a path;

means for monitoring a plurality of package wrap parameters of a continuously moving package without contacting said package, to determine whether predetermined standards for the package wrap have been exceeded, said monitoring means comprising a plurality of photo-switch pairs arranged adjacent said path in position relative to said package to signal the presence of loose end flaps or end labels; pulled out tucks or loose girth wrap; and loose girth seam of said package wrap as said package moves continuously along said path; and means responsive to said parameter monitoring means for rejecting defectively wrapped package from said conveying means.

11. An improved inspection and sorting apparatus for wrapped packages, comprising:

means for continuously conveying said packages along a path;

means for monitoring a plurality of package wrap parameters of a continuously moving package without contacting said package, to determine whether predetermined standards for the package wrap have been exceeded, said monitoring means comprising at least one first photo-switch pair oriented in a plane adjacent at least one of the ends of said wrapped package for signalling the presence of loose end flaps or labels; and at least one second photo-switch pair oriented in a plane adjacent each side edge of said wrapped package for signalling the presence of pulled out tucks or loose girth wrap, said second photo-switch pair being oriented to project its light beam approximately over the center of the corner edges of said wrapped package.

12. An improved inspecting and sorting apparatus for wrapped packages, comprising:

means for conveying said packages along a path;

means for monitoring a plurality of package wrap parameters to determine whether predetermined standards for the package wrap have been exceeded, said monitoring means comprising means for directing an air blast at the girth seam of said package and a photo-switch pair oriented in a plane adjacent the surface of said wrapped package in which said girth seam is located, whereby the presence of a loose girth seam may be detected; and means responsive to said parameter monitoring means for rejecting defectively wrapped packages from said conveying means.

13. The apparatus according to claim 12, wherein said monitoring means further comprises at least one first photo-switch pair oriented in plane adjacent at least one of the ends of said wrapped package for signalling the presence of loose end flaps or labels; and at least one second photo-switch pair oriented in a plane adjacent each side edge of said wrapped package for signalling the presence of pulled out tucks or loose girth wrap, said second photo-switch pair being oriented to project its light beam approximately over the center of the corner edges of said wrapped package.

14. An improved inspecting and sorting apparatus for wrapped packages, comprising:

means for conveying said packages along a path;

means for monitoring a plurality of package wrap parameters to determine whether predetermined standards for the package wrap have been exceeded; and means responsive to said parameters monitoring means for rejecting defectively wrapped packages from said conveying means, said rejecting means comprising:

stop gate means for restraining defectively wrapped packages on said conveying means in response to said parameter monitoring means;

means for monitoring the presence of a defectively wrapped package near said stop gate means; and reject conveyor means responsive to said presence monitoring means for conveying defectively wrapped packages from said conveyor.

15. In a package labelling machine of the type comprising a first conveyor for packages to be labelled, a label magazine and a label applying head for removing labels from said magazine and applying them to said packages, the improvement comprising:

means for detecting, for each individul package while it is conveyed past said label applying head, a failure to remove a label from said magazine or a loss of a removed label from said applying head, said detecting occurring prior to the time at which said each individual package normally would receive a label from said applying head, and means responsive to said failure detecting means for rejecting defectively labelled packages from said conveyor.

16. The apparatus according to claim 15, wherein said labels are removed by a vacuum acting at said label applying head and said detecting means comprises a vacuum switch connected in pneumatic circuit with said label applying head.

17. The apparatus according to claim 15, wherein said rejecting means comprises stop gate means for restraining defectively labeled packages on said conveyor in response to said control signal; means for monitoring the presence of a defectively labeled package near said stop gate means and reject conveyor means responsive to said monitoring means for conveying defectively wrapped packages from said conveyor.

18. The apparatus according to claim 15, wherein said rejecting means comprises a second conveyor oriented to receive packages from said first conveyor, said second conveyor being pivotably mounted at its infeed end for lowering its outfeed end below the level of said first conveyor; means for detecting the presence of a defectively labeled package on said second conveyor; and means responsive to said presence detecting means for lowering said second conveyor to reject said defectively labeled package.

19. The apparatus according to claim 15, further comprising means for conveying and storing said rejected packages.

20. The apparatus according to claim 18, further comprising, means for detecting the passage of a defectively labeled package leaving said second conveyor and means responsive to said passage detecting means for raising said second conveyor back to the level of said first conveyor to receive subsequent packages.

21. The apparatus of claim 17, wherein said reject conveyor comprises an infeed roller driven from the outfeed end of said first conveyor.

22. The apparatus of claim 18, wherein said second conveyor comprises an infeed roller driven from the outfeed end of said first conveyor.

23. In combination, a package machine having a first conveyor for packages to be labeled, a label magazine and a label applying head for removing labels from said magazine and applying them to said packages;

means for detecting the failure to remove a label from said magazine or loss of a removed label from said applying head prior to application to said packages;

means for conveying wrapped, labeled packages from said first conveyor along a path;

means for monitoring a plurality of package wrap parameters to determine whether predetermined standards for the package wrap have been exceeded; and means responsive to either or both of said failure detecting means and parameter monitoring means for rejecting defectively labeled and/or wrapped packages from said conveying means.

24. The apparatus according to claim 23, further comprising means for conveying and storing said rejected packages.

25. The apparatus according to claim 23, wherein said monitoring means includes means for signalling the presence of loose end flaps or end labels of said package wrap.

26. The apparatus according to claim 23, wherein said monitoring means includes means for signalling the presence of pulled out end tucks or loose girth wrap of said package wrap.

27. The apparatus according to claim 23, wherein said monitoring means includes means for signalling the presence of a loose girth seam of said package wrap.

28. The apparatus according to claim 25, wherein said means for signalling the presence of loose end flaps or end labels comprises at least one photo switch pair oriented in a plane adjacent at least one of the ends of said wrapped package, at at least one station along said path.

29. The apparatus according to claim 26, wherein said means for signalling the presence of pulled out tucks or loose girth wrap comprises at least one photo switch pair oriented in a plane adjacent each side edge of said wrapped package, at at least one station along said path.

30. The apparatus according to claim 29, wherein said photo switch pair is oriented to project its light beam approximately over the center of the corner edges of said wrapped package.

31. The apparatus according to claim 27, wherein said means for signalling the presence of a loose girth seam comprises means for directing an air blast at said girth seam and a photo switch pair oriented in a plane adjacent the surface of said wrapped package in which said girth seam is located.

32. The apparatus according to claim 23, wherein said rejecting means comprises stop gate means for restraining defectively wrapped packages on said conveying means in response to either or both of said failure detecting and parameter monitoring means; means for monitoring the presence of a defectively wrapped package near said stop gate means; and reject conveyor means responsive to said presence monitoring means for conveying defectively wrapped packages from said conveyor.

33. The apparatus according to claim 23, wherein said labels are removed by a vacuum acting at said label applying head and said detecting means comprises a vacuum switch connected in pneumatic circuit with said label applying head.

34. The apparatus according to claim 23, wherein said means for rejecting defectively labeled and/or wrapped packages comprises memory means responsive to said failure detecting means for synchronizing operation of said rejecting means to account for separation along said conveyor between said labeling machine and said monitoring means.

* * * * *